US007970299B2

(12) United States Patent
Sato

(10) Patent No.: US 7,970,299 B2
(45) Date of Patent: Jun. 28, 2011

(54) IMAGE FORMING APPARATUS CAPABLE OF DETECTING SURFACE TEMPERATURE ROTATING BODY WITHOUT CONTACT

(75) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/510,614

(22) Filed: Aug. 28, 2006

(65) Prior Publication Data

US 2007/0140719 A1 Jun. 21, 2007

(30) Foreign Application Priority Data

Sep. 16, 2005 (JP) ..... 2005-271169

(51) Int. Cl.
*G03G 15/20* (2006.01)

(52) U.S. Cl. ..... 399/44; 399/69; 399/94; 399/320

(58) Field of Classification Search ..... 399/44, 399/69, 94, 320–342, 126
See application file for complete search history.

(56) References Cited

U.S. PATENT DOCUMENTS 5,281,793 A * 1/1994 Gavin et al. ..... 219/216
5,735,604 A * 4/1998 Ewals et al. ..... 374/134
5,862,436 A * 1/1999 Ishizawa et al. ..... 399/69
2001/0017992 A1* 8/2001 Hayashi et al. ..... 399/68
2004/0057493 A1* 3/2004 Ishikawa et al. ..... 374/120
2004/0086295 A1* 5/2004 Peng et al. ..... 399/69
2004/0109490 A1* 6/2004 Asakura et al. ..... 374/133
2005/0111863 A1* 5/2005 Ogashima ..... 399/69
2005/0226645 A1* 10/2005 Sone et al. ..... 399/69
2006/0153275 A1* 7/2006 Ishikawa et al. ..... 374/141
2007/0242959 A1* 10/2007 Aono et al. ..... 399/13
2007/0280713 A1* 12/2007 Tsueda et al. ..... 399/69
2008/0069581 A1* 3/2008 Otsuka ..... 399/69

FOREIGN PATENT DOCUMENTS

JP 2001-242741 9/2001
JP 2005-242303 9/2005

* cited by examiner

*Primary Examiner* — David M Gray
*Assistant Examiner* — G. M. Hyder
(74) *Attorney, Agent, or Firm* — Rabin & Berdo, P.C.

(57) ABSTRACT

The aim of the present invention is to provide an image forming apparatus that accurately detects surface temperature of a rotating body using a noncontact temperature detection section and corrects the detected temperature according to the temperature of the surrounding area. The present invention detects the temperature of a thermal unit and the temperature of a holding unit and corrects the temperature of the thermal unit based on the temperature of the holding unit so that effects from the temperature of a surrounding area can be corrected and the temperature can accurately be detected without scarring a surface of the rotating body. Accurate regulation of the surface temperature of the rotating body can therefore be performed.

18 Claims, 23 Drawing Sheets

PERIOD WHERE ROLLER IS ROTATING (Tc - Tamb) = 1.45x (Tnc-Tamb) + 0.00

PERIOD WHERE ROLLER IS STOPPED (Tc - Tamb) = 1.34x (Tnc-Tamb) + 0.00

CONSTANT CORRECTION COEFFICIENT A

IMAGE FORMING APPARATUS CAPABLE OF DETECTING SURFACE TEMPERATURE ROTATING BODY WITHOUT CONTACT

BACKGROUND OF THE INVENTION

1. Field of the Invention

The present invention relates to an image forming apparatus having a fusing section that has a rotating body fusing a developer onto a medium through heat and a noncontact temperature detection section for detecting the temperature of a surface of the rotating body.

2. Description of Related Art

Image forming apparatuses such as electrophotographic printers, copiers, fax machines, and complex machines transfer developer corresponding to the printing image to the medium and fuse the developer to the medium through heat and pressure. Conventionally, the temperature for fusing the developer to this medium is detected through contact with a temperature detection section such as a thermistor on the surface of the rotating body fused with the developer. The temperature of the surface of the rotating body is then regulated to a proper temperature based on this detected temperature.

The temperature detection section in contact with the surface of the rotating body, however, due to being fixed, creates friction between the temperature detection section and the rotating body through rotating performance of the rotating body fused with the developer. Through this friction, the surface of the rotating body is scarred and there is a problem that these scars lower the quality of the printing image.

A method to detect the temperature of the surface of the rotating body using a noncontact temperature detection section that does not touch the surface of the rotating body is developed. (see generally, Japanese Application Publication JA2001-242741)

Where a noncontact temperature detection section is used, however, there is a problem that a large detection error arises where there is a large difference in the temperature of the surrounding area because the surface temperature of the rotating body is not detected directly.

The present invention takes the aforementioned situation into account and aims to provide an image forming apparatus that accurately detects the surface temperature of the rotating body using the noncontact temperature detection section and corrects the detected temperature according to the temperature of the surrounding area.

SUMMARY OF THE INVENTION

The image forming apparatus of the present invention has a fusion section capable of detecting without contact the surface temperature of a rotating body rotating in the feeding direction of a medium to fuse developer deposited on the medium by heat from a heating source, a thermal unit for heating the rotating body that is disposed in a direction opposite to the rotating body, a thermal section temperature detection section for detecting the temperature of the thermal section, a holding unit for holding the thermal section, a holding unit temperature detection section for detecting the temperature of the holding section, and a temperature calculation section for correcting the temperature detected by the thermal unit temperature detection section based on the temperature detected by the holding unit temperature detection section and for calculating the surface temperature of the rotating body.

The image forming apparatus of the present invention detects the temperature of the holding unit and the temperature of the thermal unit and corrects the temperature of the thermal unit based on the temperature of the holding unit. In other words, the correction is made in accordance with the temperature of the surrounding area. The temperature can be accurately detected, with the effect of the temperature of the surrounding area having been corrected, without scarring the surface of the rotating body. Accurate regulation of the surface temperature of the rotating body can therefore be executed.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DESCRIPTION OF PREFERRED EMBODIMENTS

First Embodiment

Figure 1:
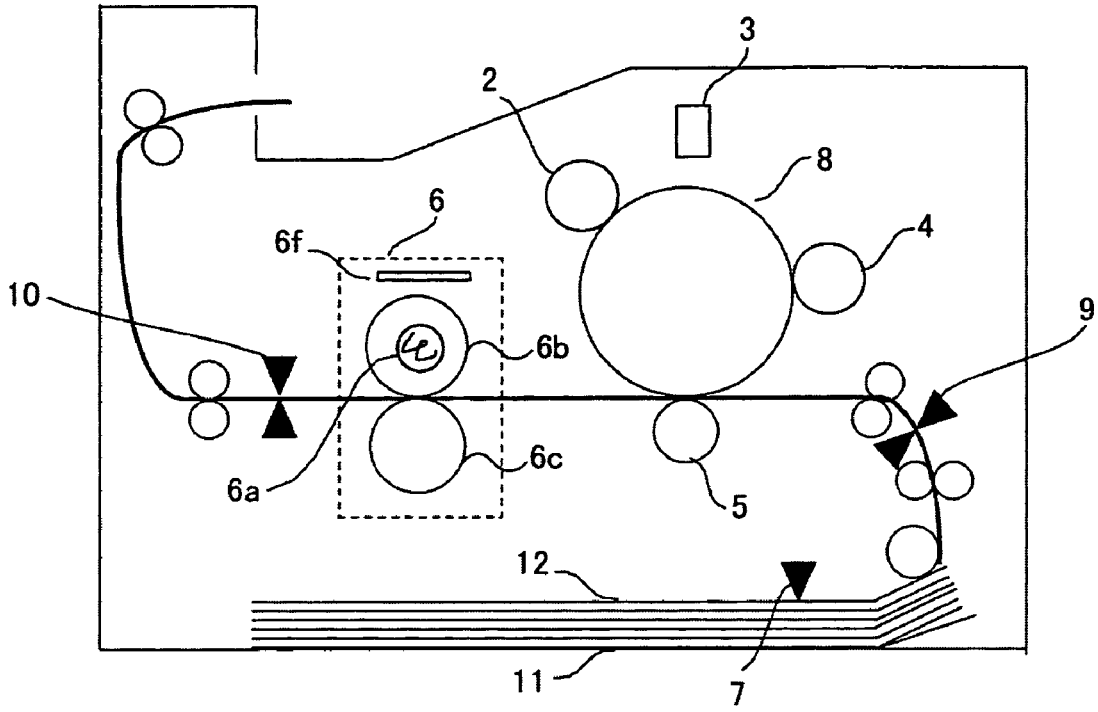
FIG. 1 is a schematic diagram showing the layout of the image forming apparatus of the first embodiment.

The image forming apparatus, as shown in FIG. 1, has a charge device 2, an exposure device 3, a development device 4, a transfer device 5, a fusion device 6, a remaining medium sensor 7, a photosensitive drum 8, an input sensor 9, an output sensor 10, and a medium cassette 11. A medium 12, e.g., paper, is stored inside the medium cassette 11.

Figure 2:
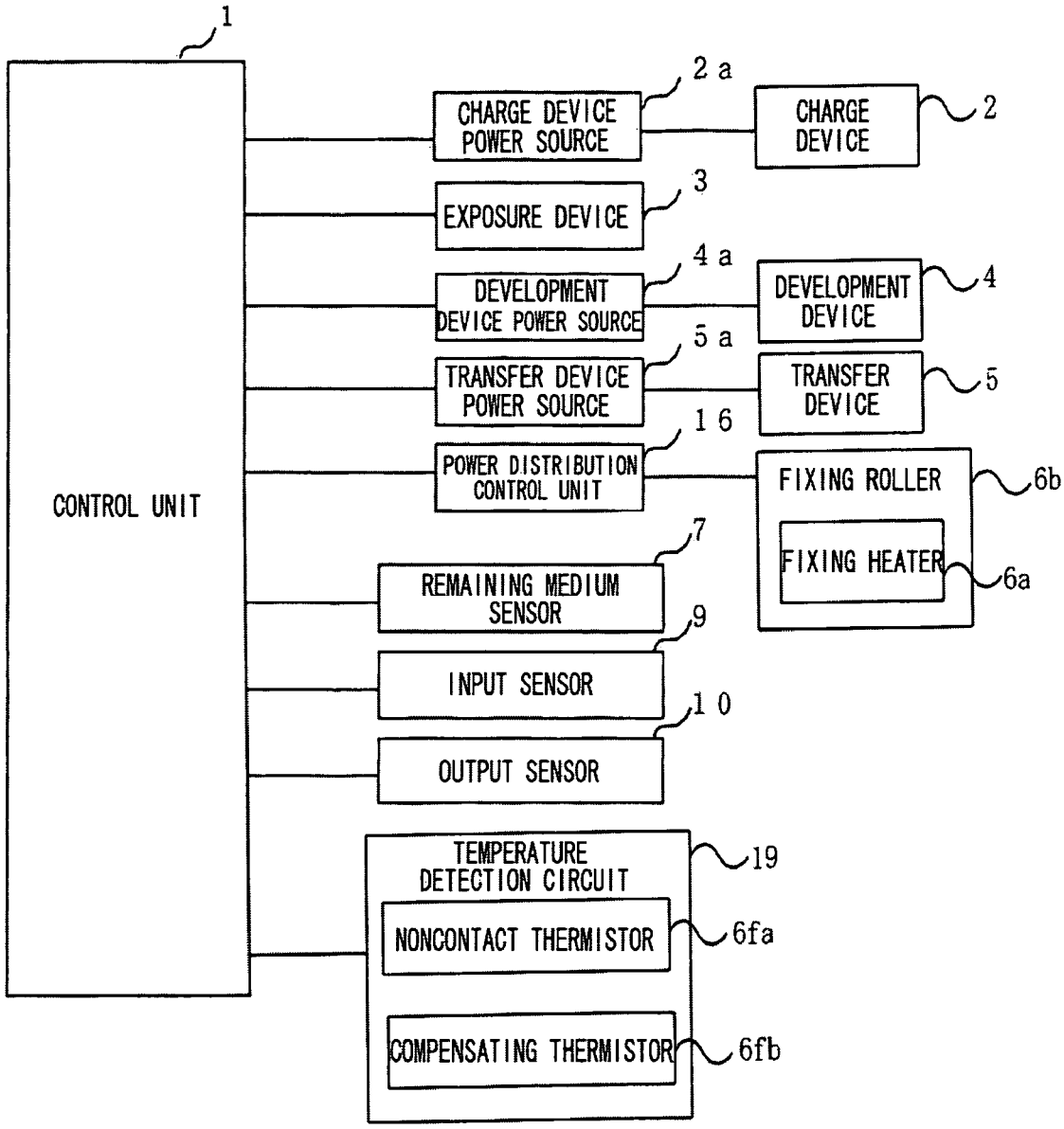
FIG. 2 is a block diagram of the image forming apparatus of the first embodiment.

The image forming apparatus, as shown in FIG. 2, has a control unit 1 connected to each of the aforementioned components. This control unit 1 is connected to a charge device power source 2*a*, a development device power source 4*a*, a transfer device power source 5*a*, a power distribution control unit 16, the exposure device 3, a remaining medium sensor 7, the input sensor 9, the output sensor 10, and a temperature detection circuit 19.

The medium cassette 11, as shown in FIG. 1, is a box-shaped component that stacks the medium 12 that forms the image and has at least an opening in the top for taking out the medium 12. This medium cassette 11 has the remaining medium sensor 7 that scans the remaining amount of the medium 12. This medium cassette 11 also has a paper supply roller in contact with the medium 12 inside the medium cassette 11. The control unit 1 can supply the medium 12 from the medium cassette 11 to the feeding path by the performance of this paper supply roller.

The remaining medium sensor 7 is a sensor for detecting whether there is a medium 12 in the medium cassette 11. This remaining medium sensor 7 is connected to the control unit 1 and sends information concerning the remaining amount of the medium 12 in the medium cassette 11 to the control unit 1. By detecting the existence of the medium 12 in the medium cassette 11, the medium 12 is supplied to the feeding path by the paper supply roller. The control unit 1 receiving the information concerning the remaining amount of the medium 12 can display a signal corresponding to the remaining amount of the medium, for example, a signal that there is no medium 12 in the medium cassette 11, in a display unit, not shown, or the like of the apparatus.

The input sensor 9 is located further downstream from the medium cassette 11 of the feeding path and detects whether the medium 12 is fed to the feeding path. This input sensor 9 is connected to the control unit 1 and sends the detected signal to the control unit 1. The control unit 1 then controls each member that will be explained later in a manner to form images on the medium 12 based on the signal transmitted by the input sensor 9.

The photosensitive drum 8 is an electrostatic latent image carrier and, through the charge device 2, is constructed in a manner capable of accumulating electrical charge on the surface. This photosensitive drum 8 is, for example, secured on an axis in a manner allowing rotation around a shaft serving as the central axis secured to both ends of a frame, not shown, equipped by this photosensitive drum 8. The photosensitive drum 8 is constructed in a manner capable of removing the electrical charge accumulated on the surface with the exposure device 3. The photosensitive drum 8 forms a toner image by attaching toner serving as a developer to the electrostatic latent image formed on the surface.

The charge device 2 can accumulate electrical charge on the surface of the photosensitive drum 8 through the application of a prescribed positive or negative voltage to the photosensitive drum 8. This charge device 2 is, for example, a semiconductive charge roller secured on an axis in a manner allowing rotation in a frame, not shown, and touching the surface of the photosensitive drum 8 with a certain pressure. In order to apply the prescribed voltage to the photosensitive drum 8, this charge device 2 is connected to the charge device power source 2*a*, and this charge device power source 2*a* is controlled by the control unit 1. The control unit 1 controls the charge device power source 2*a* in a manner to apply the prescribed voltage to the photosensitive drum 8 based on the signal from the input sensor 9. The charge device 2 generates, for example, a voltage of −1000V to −1100V.

The exposure device 3 is located above the photosensitive drum 8, further downstream in the rotation of the photosensitive drum 8 than the charge device 2. This exposure device 3 is, for example, an LED (Light Emitting Diode) head, laser, and the like, removes the electrical charge accumulated on the surface of the photosensitive drum 8 by the charge device 2 through exposure, and forms an electrostatic latent image on the surface of the photosensitive drum 8. The electrostatic latent image is formed on the photosensitive drum 8 from, for example, a voltage of −50V to 0V. This exposure device 3 is connected to the control unit 1 and executes exposure via the control unit 1 based on printing data sent to the image forming apparatus.

The development device 4 supplies toner, charged with the same electrical charge as the electrical charge charged on the surface of the photosensitive drum 8 by the charge device 2, to the surface of the photosensitive drum 8 by electrical attraction force. Toner is affixed to the portion of the surface of the photosensitive drum 8 from which the electrical charge was removed by exposure and the toner image is formed on the surface of the photosensitive drum 8. This development device 4 is located further downstream in the rotation of the photosensitive drum 8 than the exposure device 3 and, for example, is secured to an axis in a manner allowing rotation in a frame, not shown, to contact the surface of the photosensitive drum 8 with the prescribed pressure. This development device 4 is connected to the development device power source 4*a* and the toner is charged with the prescribed charge by this development device power source 4*a*. This development device power source 4*a* is controlled by the control unit 1 based on a signal from the input sensor 9.

The transfer device 5 applies a prescribed positive or negative voltage using the connected transfer device power source 5*a* to accumulate an electrical charge on the surface of the photosensitive drum 8 opposite to the electrical charge of the toner charged by the development device 4. The transfer device 5 transfers, by electrical attraction, the toner image formed on the photosensitive drum 8 to the medium 12 fed through the feeding path. This transfer device 5 is equipped sandwiching the feeding path on the opposite side of the photosensitive drum 8 and is secured rotatably, for example, on an axis. The transfer device power source 5*a* is controlled by the control unit 1 to apply the prescribed voltage to the transfer unit 5 based on the signal from the input sensor 9. The voltage applied to the transfer unit 5 is, for example, +2000V to +3000V. The medium 12 having the toner image is fed to the fusion device 6 through the feeding path.

Figure 3:
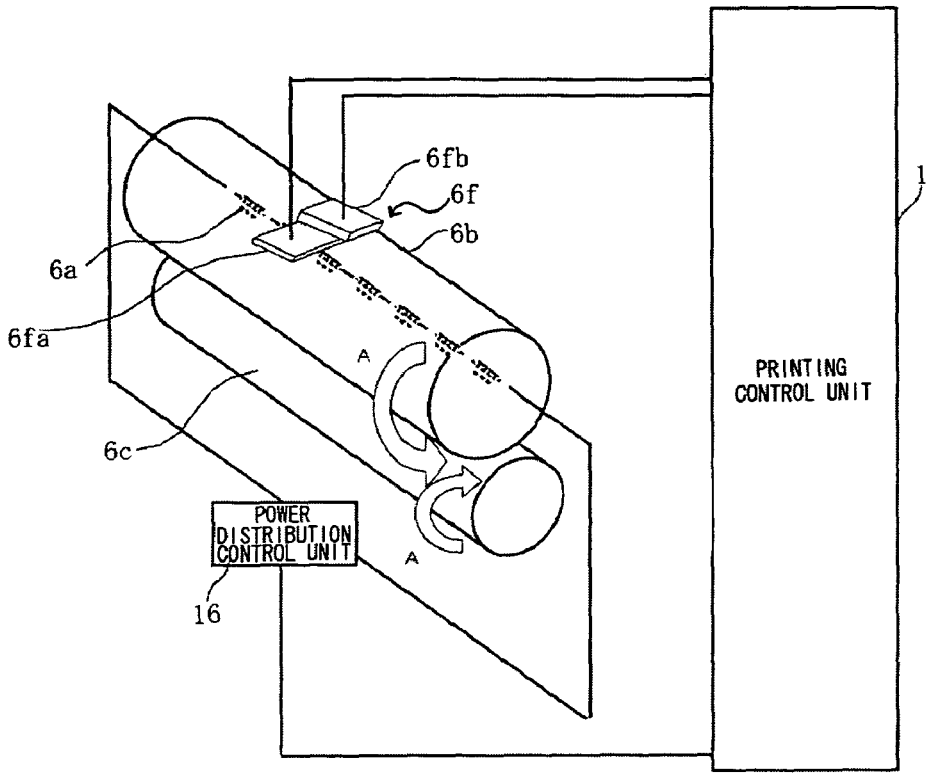
FIG. 3 is a diagram explaining the fusion device of the image forming apparatus of the first embodiment.

The fusion device 6, as shown in FIG. 3, is constructed from a fixing heater 6*a*, a fixing roller 6*b*, a pressurization roller 6*c*, and a noncontact temperature detection unit 6*f*. The fixing heater 6*a* is placed inside the fixing roller 6*b*. This fixing heater 6*a* is connected to the power distribution control unit 16 and heats up in accordance with the voltage applied from the power distribution control unit 16. This heat is conveyed from the fixing heater 6*a* to the fixing roller 6*b*. The control unit 1 controls the voltage applied by this power distribution control unit 16 to set the prescribed temperature of the fixing roller 6*b*. A ceramic heater may be held inside the fixing roller 6*b* in place of the fixing heater 6*a*.

The fixing roller 6*b* is a rotating body secured on an axis in a manner allowing rotation in a direction of the medium 12 flowing from the feeding path upstream to downstream (the direction of the middle arrow A in FIG. 3) and is positioned to contact the fed medium 12. This fixing roller 6*b* can uniformly apply heat by the heat generated by the fixing heater 6*a*.

The power distribution control unit 16 changes the power distribution condition of the fixing heater 6*a* through the commands from the control unit 1. In other words, the power distribution unit 16 turns on and off the power distribution to the fixing heater 6*a* to set the surface temperature of the fixing roller 6*b* detected by the temperature detection unit 6 to a prescribed range of, for example, 170° C.±10° C. For example, in a case where the surface temperature of the fixing roller 6*b* detected by the temperature detection unit 6 is higher than the prescribed range, the power distribution control unit receives a command from the control unit 1 to turn off the power distribution to the fixing heater 6*a* and proceeds to turn off the power distribution to the fixing heater 6*a*. On the other hand, in a case where the surface temperature of the fixing roller 6*b* detected by the temperature detection unit 6 is lower than the prescribed range, the power distribution control unit receives a command from the control unit 1 to turn on the power distribution to the fixing heater 6*a* and proceeds to turn on the power distribution to the fixing heater 6*a*.

The pressurization roller 6*c* is equipped on the opposite side of the fixing roller 6*b* and is secured on an axis in a manner allowing rotation in a direction of the medium 12 flowing from the feeding path upstream to downstream (the direction of the middle arrow A' in FIG. 3) to add the prescribed pressure to the fed medium 12. Through this, the pressurization roller 6*c* can apply the prescribed pressure to the medium 12 fed in through the feeding path. The toner image can be fused to the medium 12, affixing the toner to the medium fed 12, through the heat of the fixing roller 6*b* and the pressure of the fixing roller 6*b* and the pressurization roller 6*c*.

Figure 4:
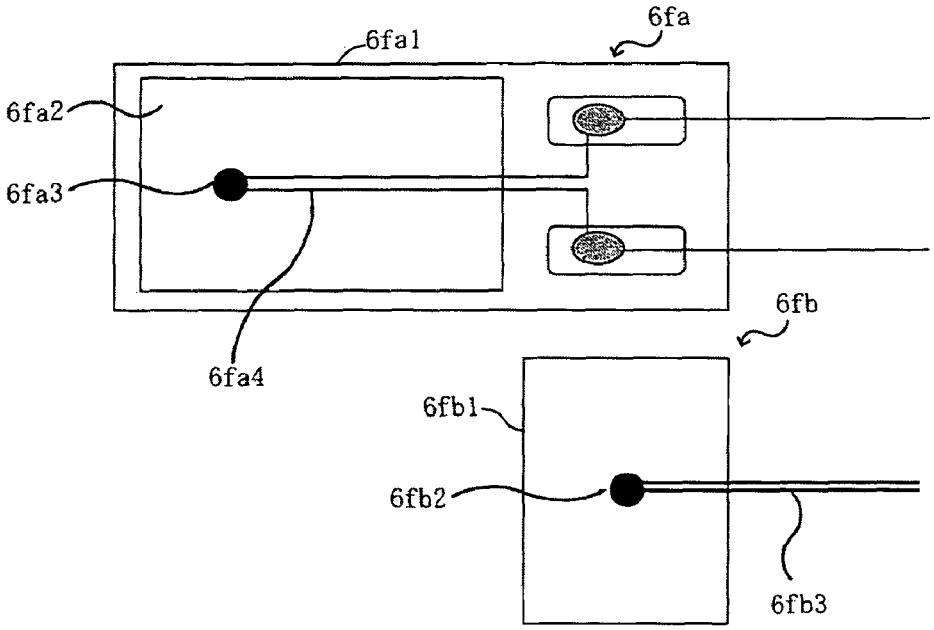
FIG. 4 is a diagram explaining the structure of the dismantled temperature detection unit of the image forming apparatus of the first embodiment.

The temperature detection unit 6*f*, as shown in FIG. 4, is made from a noncontact thermistor 6*fa* and a compensating thermistor 6*fb*. The noncontact thermistor 6*fa* has a plate-like holding unit 6*fa*1. A thermosensitive film 6*fa*2 that is smaller than the holding unit 6*fa*1 is carried on top of the holding unit 6*fa*1. This thermosensitive film 6*fa*2 is a film-like thermal unit heated by absorbing infrared radiation emitted from the fixing roller 6*b*. Because of this, the temperature of this thermosensitive film 6*fa*2 changes according to the temperature change of the surface of the fixing roller 6*b*. The temperature of the holding unit 6*fa*1 holding the thermosensitive film 6*fa*2 changes according to the temperature change of the thermosensitive film 6*fa*2. The holding unit 6*fa*1 holds a noncontact thermistor element 6*fa*3 that is a thermal unit temperature detection section for detecting the temperature of the thermosensitive film 6*fa*2 via the thermosensitive film 6*fa*2.

The noncontact thermistor element 6*fa*3 has wiring 6*fa*4 to form a temperature detection circuit 19 that will be described later to detect the temperature of the thermosensitive film 6*fa*2. The temperature detection circuit 19 is connected to the control unit 1. The dimensions of the noncontact thermistor 6*fa* are not particularly limited and can be, for example, a length of 20.3 mm, a width of 11.0 mm, and a thickness of 12.5 μm.

Figure 5:
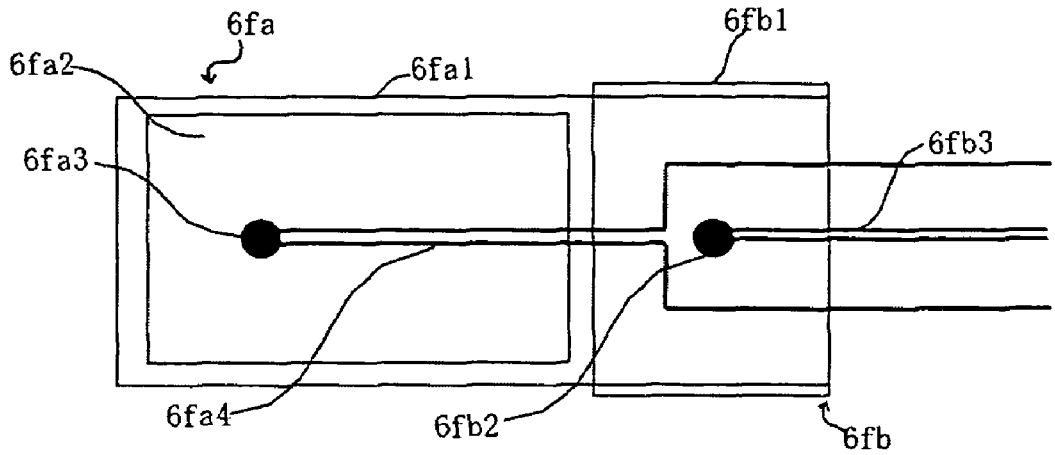
FIG. 5 is a diagram showing a stacked condition of the dismantled temperature detection unit shown in FIG. 4.

The compensating thermistor 6*fb* has a board-shaped compensating thermistor frame 6*fb*1. A compensating thermistor element 6*fb*2 is held above the compensating thermistor frame 6*fb*1. The compensating thermistor 6*fb*, as shown in FIG. 5, is equipped by the noncontact thermistor 6*fa* in a manner such that the compensating thermistor element 6*fb*2 can detect the temperature of the holding unit 6*fa*1 of the noncontact thermistor 6*fa*. The compensating thermistor element 6*fb*2 becomes a holding unit temperature detection section for detecting the temperature of the holding unit 6*fa*1.

In the same manner as the noncontact thermistor element 6*fa*3, the compensating thermistor element 6*fb*2 has wiring 6*fb*3 to form a temperature, detection circuit 19 that will be described later to detect the temperature of the holding unit 6*fa*1. The temperature detection circuit 19 is connected to the control unit 1.

Figure 6:
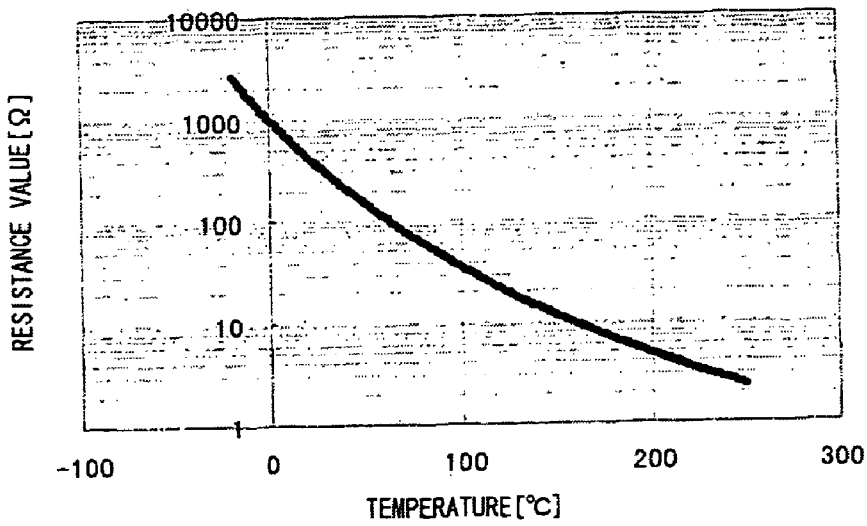
FIG. 6 is diagram showing a characteristic of the thermistor element used in the temperature detection circuit of the image forming apparatus of the first embodiment.

The compensating thermistor element 6*fb*2 and the noncontact thermistor element 6*fa*3 used here are, as shown in FIG. 6, elements that change resistance value according to temperature. There are both elements that experience decreased resistance from increased temperature and elements that experience increased resistance from increased temperatures. The present invention uses a thermistor element that experiences decreased resistance from increased temperatures but may also use a thermistor element that experiences decreased resistance from decreased temperatures.

Figure 7:
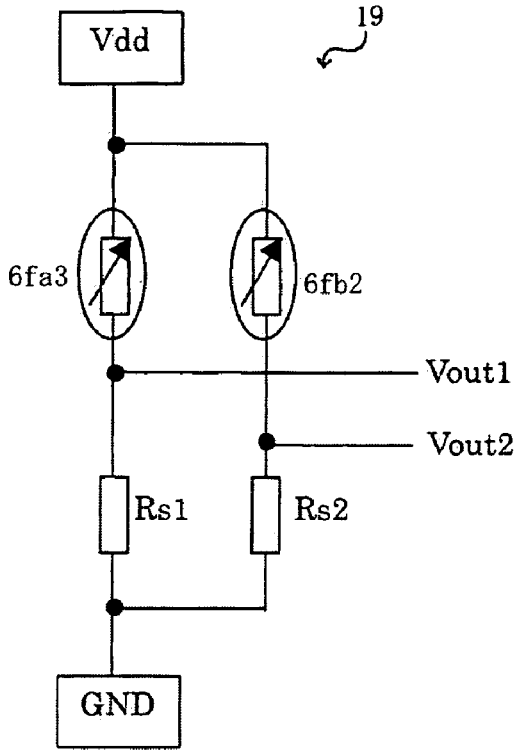
FIG. 7 is a circuit diagram showing the temperature detection circuit of the image forming apparatus of the first embodiment.

The compensating thermistor element 6*fb*2 and the noncontact thermistor element 6*fa*3 form the temperature detection circuit 19, as shown in FIG. 7, to detect the temperature of the thermosensitive film 6*fa*2 and the holding unit 6*fa*1 with the control unit 1.

The temperature detection circuit 19 has the compensating thermistor element 6*fb*2, the noncontact thermistor element 6*fa*3, and detection resistors Rs1 and Rs2. The power source unit Vdd is connected to one end of both the compensating thermistor element 6*fb*2 and the noncontact thermistor element 6*fa*1; the detection resistor Rs1 is connected to the other end of the noncontact thermistor element 6*fa*3; and the detection resistor Rs2 is connected to the other end of the compensating thermistor element 6*fb*2. A grounding portion (GND) is connected to the other end of both detection resistors Rs1 and Rs2. The temperature detection circuit 19 has a voltage detection point Vout1 between the noncontact thermistor element 6*fa*3 and the detection resistor Rs1 and a voltage detection point Vout2 between the compensating thermistor element 6*fb*2 and the detection resistor Rs2.

Figure 8:
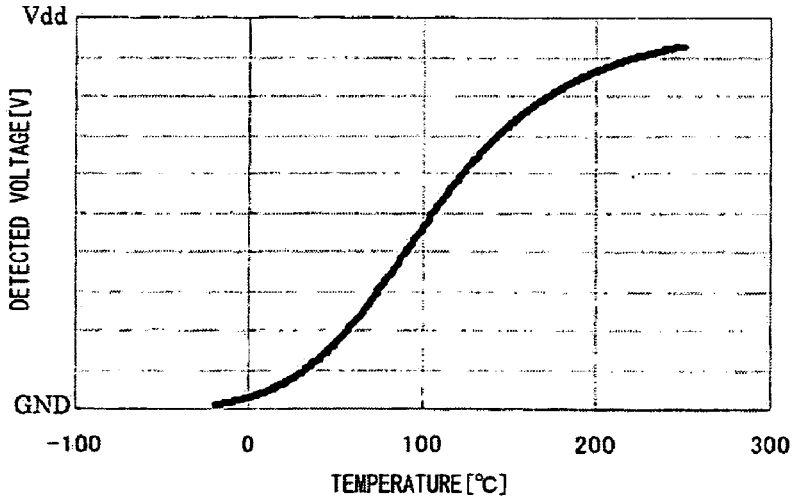
FIG. 8 is a diagram showing the relationship between the temperature and voltage detected by the thermistor element contained in the temperature detection circuit of the image forming apparatus of the first embodiment.

In the manner described above, the compensating thermistor element 6*fb*2 and the noncontact thermistor element 6*fa*3 equipped by the temperature detection circuit 19 change the resistance thereof according to temperature as shown in FIG. 6. Because of this, the voltage at the voltage detection points Vout1 and Vout2 changes, as shown in FIG. 8, in accordance with the temperature of the compensating thermistor element 6*fb*2 and the noncontact thermistor element 6*fa*3. That is, the voltage output from the compensating thermistor element 6*fb*2 and the noncontact thermistor element 6*fa*3 can be detected at the voltage detection points Vout1 and Vout2. Accordingly, through the control of the control unit 1 connected to the temperature detection circuit 19, the prescribed voltage is supplied from the power sources supply unit Vdd, and the temperature of the compensating thermistor element 6*fb*2 and the noncontact thermistor element 6*fa*3 can be detected by detecting the voltage at each of the voltage detection points Vout1 and Vout2 using, for example, the graph shown in FIG. 8.

The noncontact thermistor element 6*fa*3 can detect the temperature of the thermosensitive film 6*fa*2 by the voltage detected at the voltage detection point Vout1 of the control unit 1. In the same way, the compensating thermistor element 6*fb*2 can detect the temperature of the holding unit 6*fa*1 by the voltage detected at the voltage detection point Vout2 of the control unit 1.

The temperature detection unit 6*f* having the compensating thermistor element 6*fb*2 and the noncontact thermistor element 6*fa*3 is separated from the fixing roller 6*b*. The distance between the temperature detection unit 6*f* and the fixing roller 6*b* is not particularly limited and can be, for example, 0.90 mm. The temperature of the thermosensitive film 6*fa*2 changes in accordance with the change in temperature of the surface of the fixing roller 6*b* and the temperature of the holding unit 6*fa*1 changes in accordance with the change in temperature of the thermosensitive film 6*fa*2. In this way, the heat of the fixing roller 6*b* is transferred to the thermosensitive film 6*fa*2 and the heat transferred to the thermosensitive film 6*fa*2 is transferred to the holding unit 6*fa*1. Accordingly, the temperature of the surface of the fixing roller 6*b* can be regulated through the temperature detected at the thermosensitive film 6*fa*2 and the holding unit 6*fa*1.

The output sensor 10 is located further downstream of the feeding path than the fusion device 6 and detects whether the medium 12 fed from the fusion device 6 is removed. The output sensor 10 is connected to the control unit 1 and sends a signal to the control unit 1 indicating whether the medium 12 is delivered.

The control unit 1 is formed of a microprocessor, a ROM (Read Only Memory), an EEPROM (Electrically Erasable Programmable Read Only Memory), a RAM (Random Access Memory) input/output port, a timer, and the like, which are not shown. The control unit 1 is connected to an external information processing apparatus such as a personal computer and performs a process such as a printing operation in accordance with the video signal made from the integrated arrangement of the bit map data and control signal from an upper level controller and the like controlling the performance of the image forming apparatus of the present invention.

The control unit 1 is connected to each unit described above and forms an image on the medium 12 based on the printing data sent to the image forming apparatus. The control unit 1 then detects the temperature of the thermosensitive film 6*fa*2 and the holding unit 6*fa*1 from the voltage detected by the temperature detection circuit 19 and, from this temperature, acts as a temperature calculation section to calculate the temperature of the surface of the fixing roller 6*b* serving as a rotating body.

The following is an explanation of the calculation method of the surface temperature of the fixing roller 6*b* from the temperature of the thermosensitive film 6*fa*2 and the holding unit 6*fa*1 performed by the control unit 1.

Figure 9:
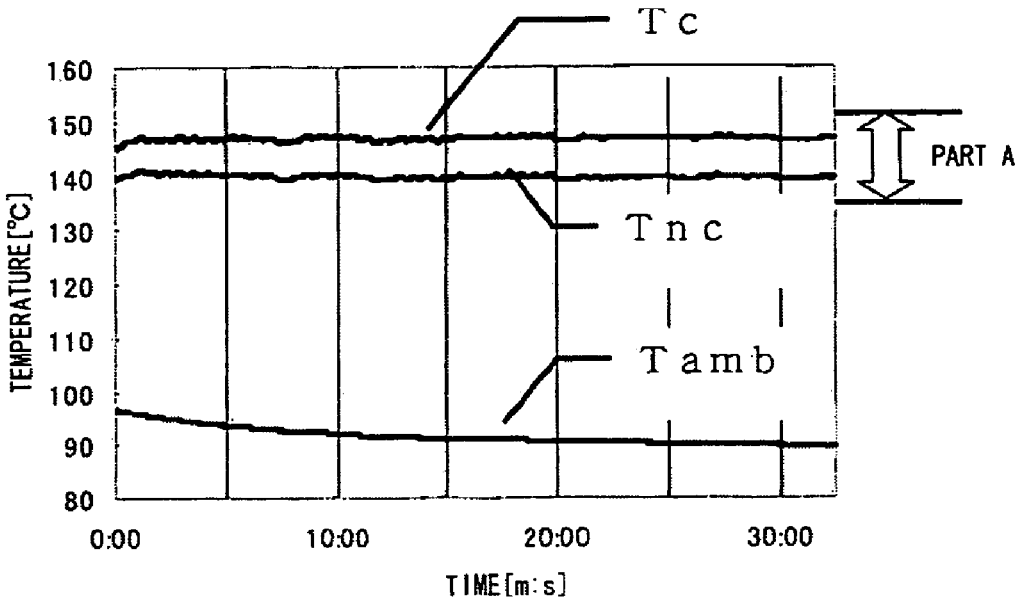
FIG. 9 is a diagram showing the relationship between the temperatures of the holding unit, thermosensitive film, and fixing roller in the image forming apparatus of the first embodiment.
Figure 10:
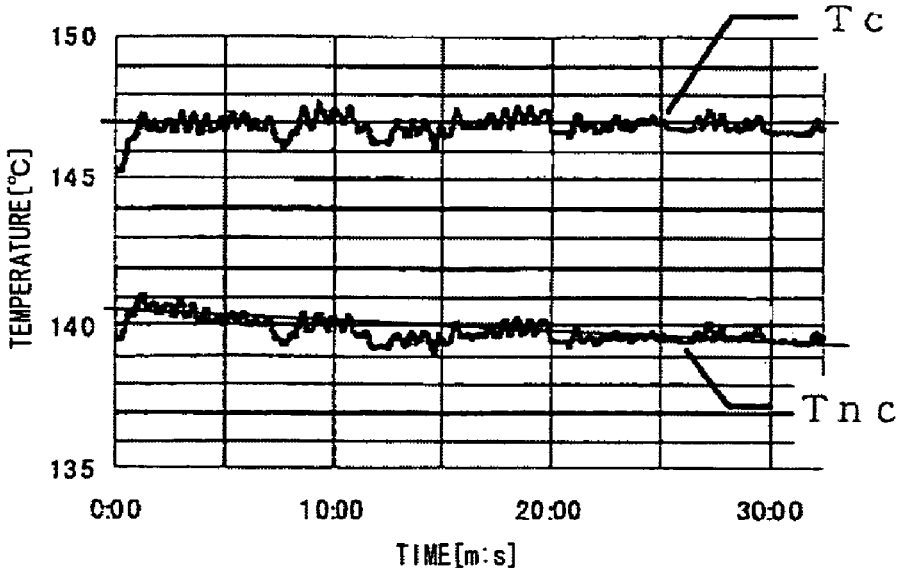
FIG. 10 is diagram showing a magnification of the portion A of FIG. 9.
Figure 11:
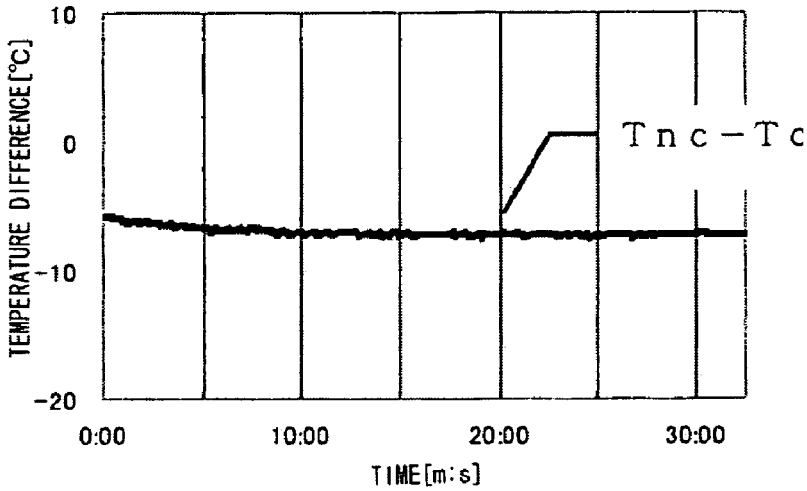
FIG. 11 is a diagram showing the difference in temperature between the holding unit, thermosensitive film, and fixing roller in the image forming apparatus of the first embodiment.

First, as shown in FIG. 9 and FIG. 10, the control unit 1 detects the change over time of the surface temperature of the fixing roller 6*b* (Tc), the temperature of the thermosensitive film 6*fa*2 (Tnc) detected by the noncontact thermistor element 6*fa*3, and the temperature of the holding unit 6*fa*1 (Tamb) detected by the compensating thermistor element 6*fb*2 using the same fusion device as the fusion device of the image forming apparatus of the present invention. FIG. 10 is a diagram showing an enlarged view of part A of FIG. 9. FIG. 11 is diagram showing the difference between Tnc and Tc over time. It is recognized that even though Tc generally remains constant, Tamb and Tnc both decrease. This is because the amount of heat (heat discharge amount) flowing from the held thermosensitive film 6*fa*2 to the holding unit 6*fa*1 increases.

Figure 12:
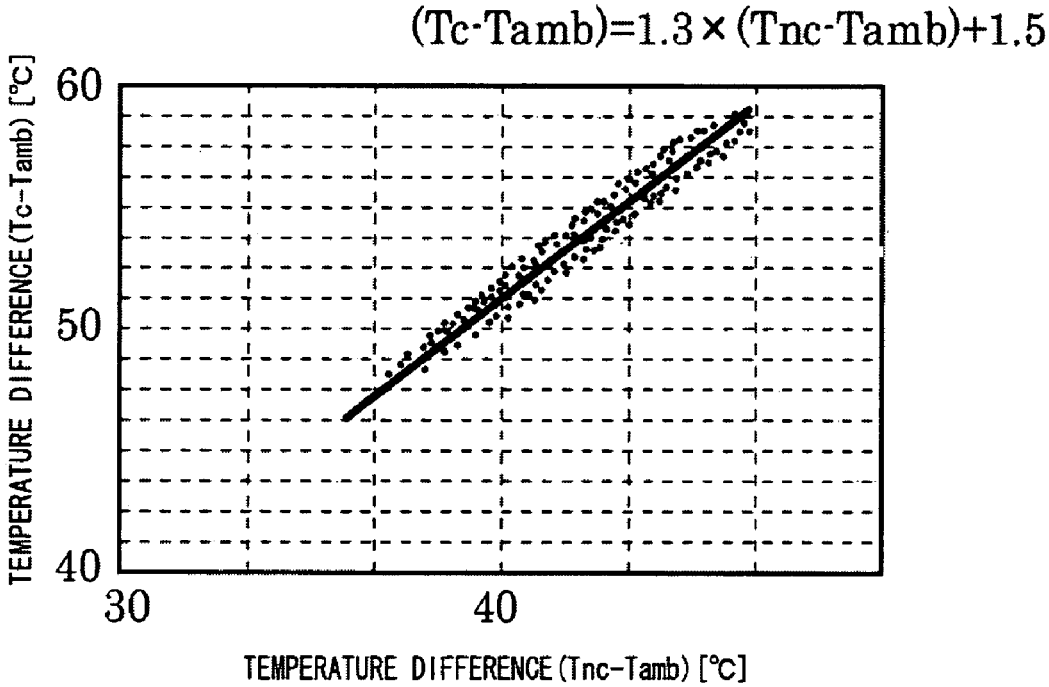
FIG. 12 is a diagram showing the correlative relationship between the difference in the temperature of the thermosensitive film and the temperature of the holding unit and the difference in the actual surface temperature of the fixing roller and the temperature of the holding unit in the image forming apparatus of the first embodiment.

The correlation between the difference of Tc and Tamb and the difference of Tnc and Tamb is shown in FIG. 12. From this graph it is recognized that there is a strong correlation between the difference of the surface temperature of the fixing roller 6*b* (Tc) and the temperature of the holding unit 6*fa*1 (Tamb) detected by the compensating thermistor element 6*fb*2 and the difference of the temperature of the thermosensitive film 6*fa*2 (Tnc) detected by the noncontact thermistor element 6*fa*3 and the temperature of the holding unit 6*fa*1 (Tamb) detected by the compensating thermistor element 6*fb*2. The approximate formula representing this relation is shown below in Equation 1.

[Equation 1]

$$(Tc-Tamb)=A\times(Tnc-Tamb)+C \qquad \text{Equation 1}$$

The simplified equation is shown below in Equation 2.

[Equation 2]

$$Tc=A\times Tnc+B\times Tamb+C \qquad \text{Equation 2}$$

The actual surface temperature of the Sing roller 6*b* (Tc) can be calculated from the temperature of the thermosensitive film (Tnc) detected by the noncontact thermistor element 6*fa*3 and the temperature of the holding unit 6*fa*1 (Tamb) detected by the compensating thermistor element 6*fb*2. From Equation 2, the actual surface temperature of the fixing roller 6*b* (Tc) can be derived from the relation of the temperature of the holding unit 6*fa*1 (Tamb) and the temperature of the thermosensitive film 6*fa*2 (Tnc). The control unit 1, requesting this relationship in advance, can calculate the surface temperature of the fixing roller 6*b* based on this relationship. In this way, the surface temperature of the fixing roller 6*b* can be accurately calculated. In other words, the temperature can be regulated to correspond to the temperature of the surrounding area by regulating the temperature of the thermosensitive film 6*fa*2 (Tnc) detected by the noncontact thermistor element 6*fa*3 to the temperature of the holding unit 6*fa*1 (Tamb) detected by the compensating thermistor element 6*fb*2. Accordingly, a more precise temperature can be detected without scarring the surface of the fixing roller 6*b*. The surface temperature of the fixing roller 6*b* can then be more precisely controlled.

The A, B, and C of aforementioned Equations 1 and 2 are numbers that are correction values for calculating the surface temperature of the fixing roller 6*b*. For example, in the approximation line graph in FIG. 12, the A, B, and C used in the equations are 1.3, −0.3, and 1.5 respectively. The calculated correction values A, B, and C are previously calculated by execution of the experiment seeking the aforementioned approximate equations and are held in the control unit 1. In the experiment, a detection section is equipped to directly detect the surface temperature of the fixing roller 6*b* (Tc) in a condition almost identical to the common usage condition and the correction values A, B, and C are calculated from this actual detected temperature and the temperature detected by the thermistor elements. The control unit 1 can accurately calculate the surface temperature of the fixing roller 6*b* using the correction values A, B, and C from the temperature of the holding unit 6*fa*1 detected by the compensating thermistor element 6*fb*2 and the temperature of the thermosensitive film 6*fa*2 detected by the noncontact thermistor element 6*fa*3. The correction values A, B, and C are determined by experimentation for every model of the image forming apparatus, so that different models have different values. For example, if the model is different, the correction values A, B, and C can become 1.45, −0.45, and 0.00 respectively, so that theses factors cause a difference in the location of the fusion device 6 and the fan inside the apparatus.

The control unit 1 holding the correction values can regulate the surface temperature of the fixing roller 6*b* to an appropriate level in the manner described below. The following is an explanation of a method for regulating the surface temperature of the fixing roller 6*b* using FIG. 13.

The control unit 1 executes the following process upon receiving the printing data. This process is executed every time temperature detection is performed by the thermistor elements. First, as shown in step S1, the control unit 1 detects and reads the value of the output voltage of the compensating thermistor element 6*fb*2 and the noncontact thermistor element 6*fa*3 at the voltage detection points Vout1 and Vout2 of the temperature detection circuit 19. The control unit 1 then converts this output voltage into temperature as shown in step S2 and detects the temperature of the compensating thermistor element 6*fb*2 and the noncontact thermistor element 6*fa*3. Because the detected voltage changes according to the temperature of the compensating thermistor element 6*fb*2 and the noncontact thermistor element 6*fa*3, the temperature of the compensating thermistor element 6*fb*2 and the noncontact thermistor element 6*fa*3 can be calculated from the detected output voltage.

The temperature detected by the noncontact thermistor element 6*fa*3 is the temperature of the thermosensitive film 6*fa*2 (Tnc). The temperature detected by the compensating thermistor element 6*fb*2 is the temperature of the holding unit 6*fa*1 (Tamb). The control unit 1 calculates the surface temperature of the fixing roller 6*b* as shown in step S3 from the held correction values A, B, and C and the detected temperature of the compensating thermistor element 6*fb*2 and the noncontact thermistor element 6*fa*3 using the formula shown in aforementioned Equation 2. At this time, the calculated surface temperature of the fixing roller 6*b* is set as Tc'.

The control unit 1, as shown in step S4, controls the surface temperature of the fixing roller 6*b* using calculated surface temperature of the fixing roller 6*b* (Tc'). At this time, the control unit 1 sends a command to the power distribution control unit 16 connected to the fixing heater 6 *a* inside the fixing roller 6*b* to turn on and off the power distribution to the fixing heater 6*a*. Upon receiving this command, the power distribution control unit 16 turns on and off the power distribution to the fixing heater 6*a*, regulates the surface temperature of the fixing roller 6*b*, and finishes this process. By repeating this process, temperature for fusing the toner to the medium 12 can be regulated to an appropriate level.

Figure 14:
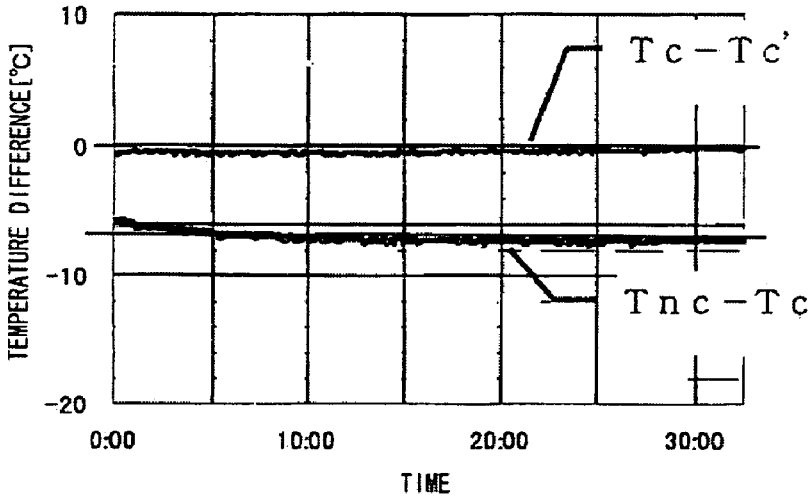
FIG. 14 is a diagram showing the difference between the actual surface temperature of the fixing roller and the calculated surface temperature of the fixing roller in the image forming apparatus of the first embodiment.
Figure 15:
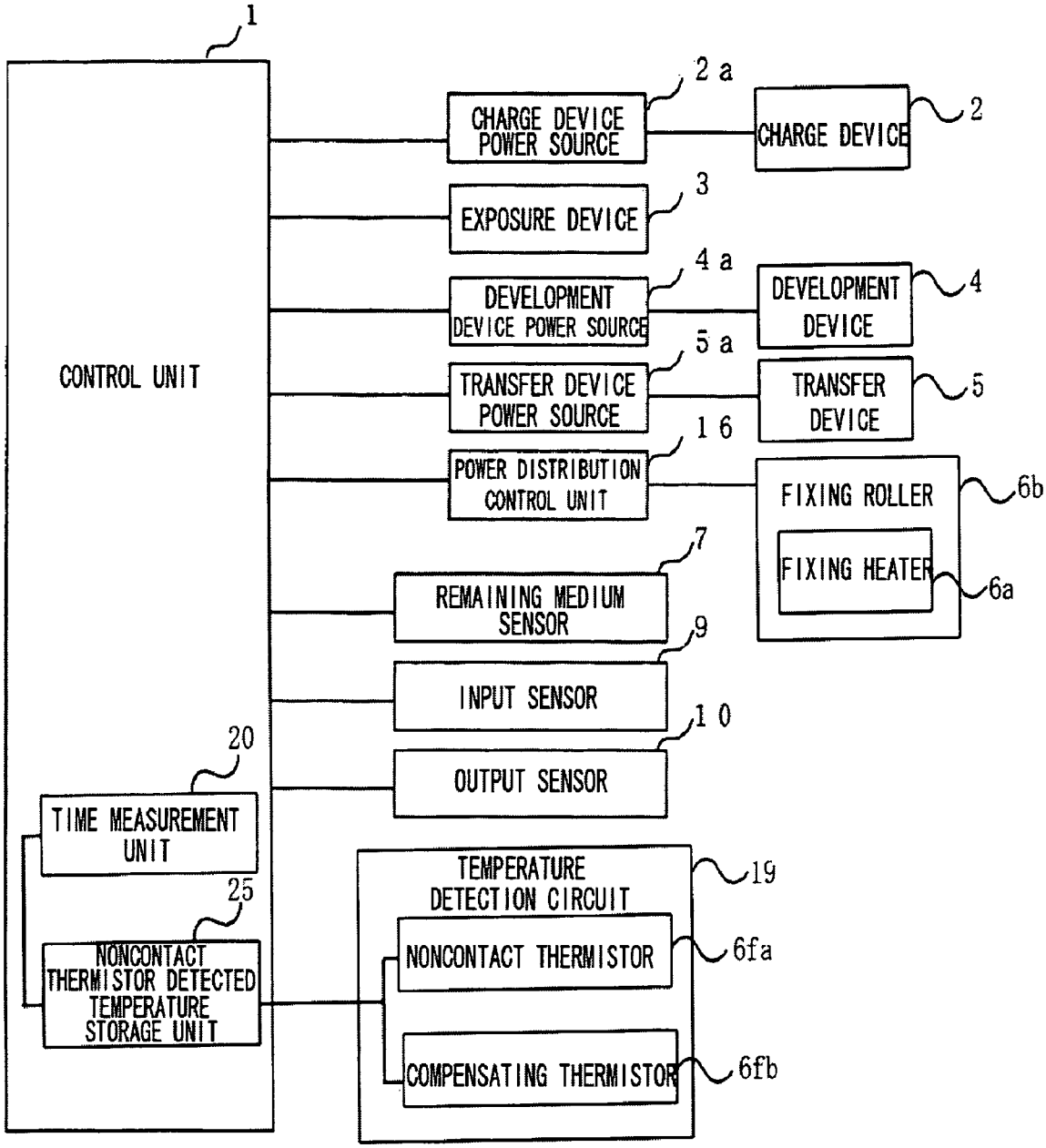
FIG. 15 is block diagram of the image forming apparatus of the second embodiment.

With the surface temperature of the fixing roller 6*b* regulated by the control unit 1, the difference between the actual surface temperature of the fixing roller 6*b* (Tc) and the calculated surface temperature of the fixing roller 6*b* (Tc') almost disappears, as shown in FIG. 14. Even though the temperature detection unit 6 that detects the surface temperature is noncontact, the surface temperature of the fixing roller 6*b* can be accurately calculated because the temperature detected by the compensating thermistor element 6*fb*2 is regulated to correspond to the temperature of the surrounding area. In other words, the correction values used in the calculation of the surface temperature of the fixing roller 6*b* can be calculated from the temperature of the thermosensitive film 6*fa*2 and the holding unit 6*fa*1 and therefore an accurate temperature can be detected.

A calculation method using the correction values A, B, and C in aforementioned Equation 1 is provided as the method for calculating the surface temperature of the fixing roller 6*b*, but the present invention is not limited to this. For example, Equation 1 may be replaced by a method using a conversion table. In this case, the characteristics of the thermistor elements and the number of temperature detection circuits are determined and the voltage detection values and the corresponding temperatures are stored in control unit 1 as one to one data for every prescribed voltage.

The equation for calculating the surface temperature of the fixing roller 6*b* is sought from the correlation between the difference of the surface temperature of the fixing roller 6*b* (Tc) and the temperature of the holding unit 6*fa*1 (Tamb) detected by the compensating thermistor element 6*fb*2 and the difference of the temperature of the thermosensitive film 6*fa*2 (Tnc) detected by the noncontact thermistor element 6*fa*3 and the temperature of the holding unit 6*fa*1 (Tamb) detected by the compensating thermistor element 6*fb*2, but the first embodiment is not limited to this. For example, the equation for calculating the surface temperature of the fixing roller 6*b* may also use the correlative relationship between the difference of the temperature of the thermosensitive film 6*fa*2 (Tnc) detected by the noncontact thermistor element 6*fa*3 and the surface temperature of the fixing roller 6*b* (Tc) and the difference of the temperature of the thermosensitive film 6*fa*2 (Tnc) detected by the noncontact thermistor element 6*fa*3 and the temperature of the holding unit 6*fa*1 (Tamb) detected by the compensating thermistor element 6*fb*2. In this case, aforementioned Equation 1 becomes Equation 3 shown below.

[Equation 3]

$$(Tc-Tnc)=A'\times(Tnc-Tamb)+C' \qquad \text{Equation 3}$$

The simplified equation is shown below in Equation 4.

[Equation 4]

$$Tc=B'\times Tnc-A'\times Tamb+C' \qquad \text{Equation 4}$$

The control unit 1 holds the correction values A', B', and C', used as the set values in Equation 3 and Equation 4 and, using Equation 4 in place of Equation 2, can calculate the surface temperature of the fixing roller 6*b* from the temperature of the thermosensitive film 6*fa*2 (Tnc) detected by the noncontact thermistor element 6*fa*3 and the temperature of the holding unit 6*fa*1 (Tamb) detected by the compensating thermistor element 6*fb*2. The surface temperature of the fixing roller 6*b* can accurately be calculated using this equation:

The image forming apparatus of the present invention constructed in the manner described above has the following performances upon receiving printing data.

Figure 13:
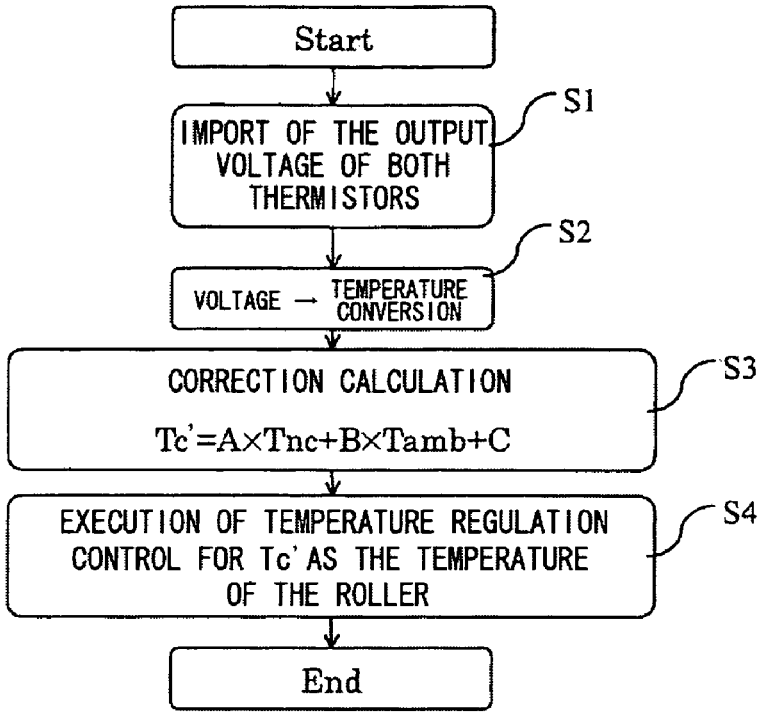
FIG. 13 is a flow chart showing the regulation of the surface temperature of the fixing roller by the control unit in the image forming apparatus of the first embodiment.

The control unit 1, upon receiving the printing data, controls the fixing heater 6*a* and the like via the power distribution control unit 16 to set an appropriate temperature used by the fixing roller 6*b* to fuse the toner to the medium 12 as shown in FIG. 13. After the temperature used by the fixing roller 6*b* to fuse the toner to the medium 12 has been set to an appropriate level, the control unit 1 detects whether the medium 12 set in the medium cassette 11 is present using the remaining medium sensor 7. Where it is detected that the medium 12 used for printing is present, the medium 12 is sent to the feeding path by the paper supply roller as described above.

A signal is sent to the control unit 1 upon the arrival at the input sensor 9 of the medium 12 sent to the feeding path. The control unit 1 receives this signal, applies voltage to the charge device 2 through the charge device power source 2*a*, and charges the surface of the photosensitive drum 8. The control unit 1 then exposes the place on the photosensitive drum 8 at which the toner is fused using the exposure device 3 based on the supplied printing data and removes the electrical charge from the photosensitive drum 8. The control unit 1 then charges the toner through the development device power source 4*a* so that the development device 4 has the prescribed charge, supplies that toner to the photosensitive drum 8, attaches the toner by electrical attraction to the place exposed by the exposure device 3, and forms the toner image on the photosensitive drum 8.

The control unit 1 applies voltage to the surface of the transfer device 5 through the transfer device power source 5*a*. Using the electrical attraction of the transfer device 5, the control unit 1 then transfers the toner image formed on the surface of the photosensitive drum to the medium 12 sent to the feeding path. The medium 12 having the transferred toner image is then sent to the fusion device 6 downstream from the photosensitive drum 8 in the feeding path. The control unit 1 fuses the toner to the medium 12 sent to the fusion device 6 by affixing the toner to the medium 12 with the pressurization roller 6*c* and the regulated temperature of the fixing roller 6*b*. The medium 12 fused with toner is sent downstream of the fusion device 6 in the feeding path, passes through the output sensor 10, and is delivered to an external apparatus such as a delivery stack. In the manner described above, the image forming apparatus described in the first embodiment can form the image on the medium 12 based on the sent printing data.

The image forming apparatus described in the first embodiment does not scar the surface of the fixing roller 6*b* and can prevent lowered quality of the image formed by using the noncontact temperature detection unit 6 to detect the surface temperature of the fixing roller 6*b*. The control unit 1, as described above, can accurately detect the temperature of the fixing roller 6*b* by using the correction values calculated from the temperature of the holding unit 6*fa*1 and the temperature of the thermosensitive film 6*fa*2 to regulate the temperature of the thermosensitive film 6*fa*2 based on the temperature of the holding unit 6*fa*1 and calculating the surface temperature of the fixing roller 6*b*. The control unit 1 can therefore detect a precise temperature from the effect of the regulated surrounding temperature without scarring the surface of the fixing roller 6*b*. The control unit 1 can accurately regulate the surface temperature of the fixing roller 6*b* and can fuse the toner onto the medium 12.

In the first embodiment, the temperature regulation of the surface of the fixing roller 6*b* at the time of printing is explained in a condition where printing data is received, but, the present invention is not limited to this condition and, the same temperature regulation is possible even while warming up, that is, in a condition where the medium 12 is not fed to the photosensitive drum 8. In the fusion device 6, because heat is stolen at the passage of the medium 12, correction values A, B, and C that are different from the correction values A, B, and C at the time of printing mentioned above are sought in advance, and the control unit 1 may calculate the precise temperature of the surface of the fixing roller 6*b* by using these correction values. In the temperature detection of the fixing roller 6*b* during warm up, the control unit 1 may detect the temperature using different correction values such as, for example, 1.40, −0.40, and 0.00 for the correction values A, B, and C respectively, so that the temperature of the fixing roller 6*b* can be accurately regulated.

Second Embodiment

The image forming apparatus described in the second embodiment further contains a time measurement unit 20 that is a time measurement section and a noncontact thermistor detected temperature storage unit 25 that is a thermal unit temperature storage section inside the control unit 1. Aside from these two units, the structure is the same as the first embodiment and therefore the same numbers will be used and an explanation will be omitted.

Figure 16:
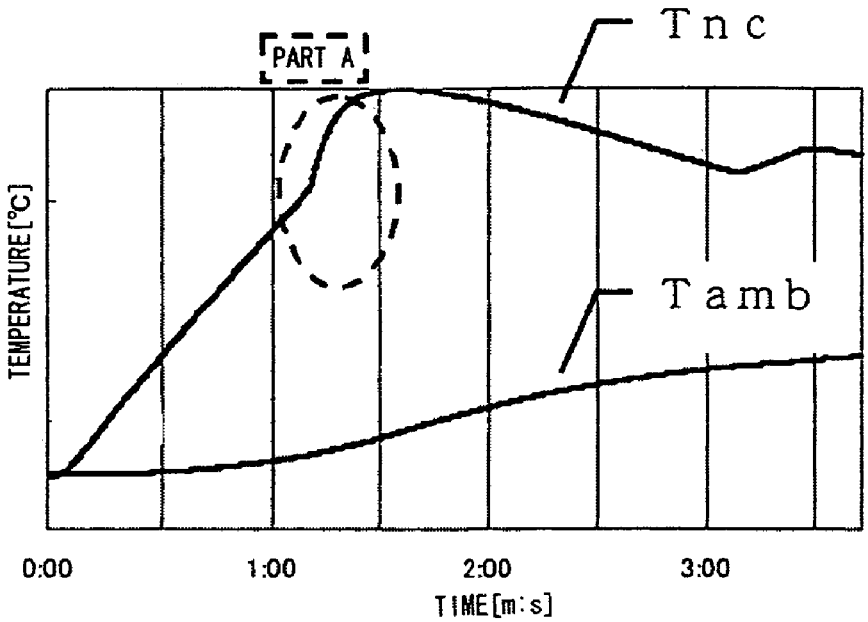
FIG. 16 is a diagram showing the relationship between the temperature of the holding unit and the temperature of the thermosensitive film in the image forming apparatus of the second embodiment.
Figure 17:
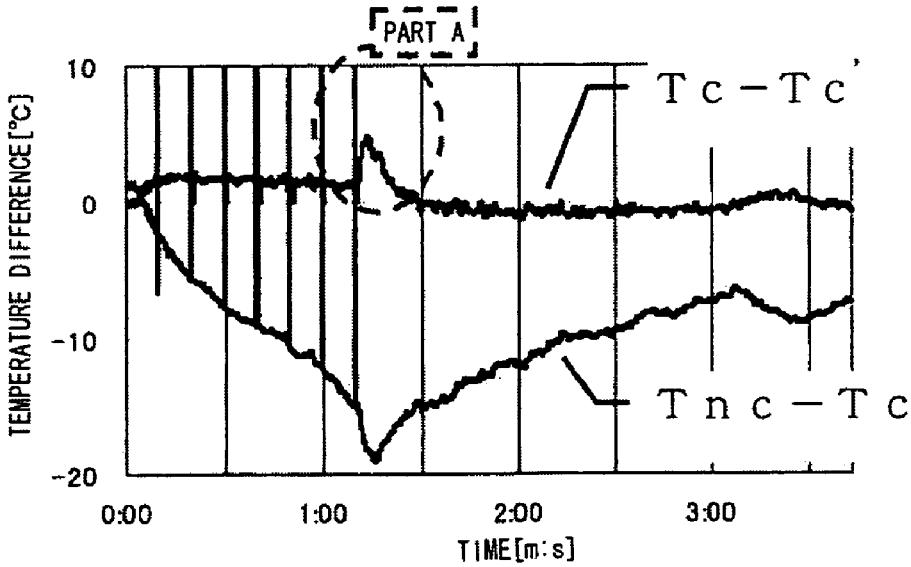
FIG. 17 is a diagram showing the relationship between the difference of the temperature of the thermosensitive film and the surface temperature of the fixing roller and the difference of the actual surface temperature of the fixing roller and the calculated surface temperature of the fixing roller in the image forming apparatus of the second embodiment.

The transfer of heat from the fixing roller 6*b* to the temperature detection unit 6*f* is delayed because the fixing roller 6*b* and the temperature detection unit 6*f* are separated. Through this delay in the transfer of heat, the temperature detected by the noncontact thermistor element 6*fb*3 of the temperature detection unit 6 (Tnc) has drastic changes in temperature as shown in part A of FIG. 16. In this case, the difference (Tc−Tc') between the actual temperature of the fixing roller 6*b* (Tc) and the temperature calculated by the temperature calculation section at the control unit 1 is very large, as shown in FIG. 17. In other words, an error arises in the detection of the actual surface temperature of the fixing roller 6*b*.

In the image forming apparatus described in the second embodiment, the time measurement unit 20 of the control unit 1 measures units of time and the temperature of the thermosensitive film 6*fa*2 detected at every unit of time is stored in the noncontact thermistor detected temperature storage unit 25. The change in temperature at a prescribed time is calculated from the temperature of the thermosensitive film 6*fa*2 for every unit of time and the aforementioned detection error can be corrected by using this amount of temperature change. In other words, the surface temperature of the fixing roller 6*b* can be calculated accurately.

The time measurement unit 20 is contained in the control unit 1 and, for example, is a clock or the like. The time measurement unit 20 measures the unit of time for every occasion where the control unit 1 executes temperature detection by the noncontact thermistor 6*fa* at every unit of time. In other words, the control unit 1 detects the temperature of the thermosensitive film 6*fa*2 using the noncontact thermistor 6*fa* for every unit of time measured by the time measurement device 20. The units of time are not particularly limited and may be, for example, 1/100 of a second.

The noncontact thermistor detected temperature storage unit 25 is a temporary storage area held in the RAM, not shown, of the control unit 1. The noncontact thermistor detected temperature storage unit 25 stores the temperature detected by the noncontact thermistor element 6*fa*3 of the noncontact thermistor 6*fa* for every unit of time in the storage area. The noncontact thermistor detected temperature storage unit 25, at the time of storage, divides the storage area into a prescribed number of spaces. The noncontact thermistor detected temperature storage unit 25 then sequentially stores the temperatures detected for each unit of time in the divided spaces.

For example, in a case where the storage area is divided into 100 spaces, the noncontact thermistor detected temperature storage unit 25 stores the first temperature detected by the noncontact thermistor element 6*fa*3 in Tnc [0]. After a unit of time passes, the temperature stored in Tnc [0] is moved to Tnc [1] and the next temperature detected by the noncontact thermistor element 6*fa*3 is stored in Tnc [0]. The noncontact thermistor detected temperature storage unit 25 repeats this process, storing the temperatures detected for every unit of time. The noncontact thermistor detected temperature storage unit 25 stores temperatures until Tnc [99] and, in a case where the next temperature is newly stored in Tnc [0], deletes the temperature stored in Tnc [99]. The stored temperatures are sequentially moved in a manner such that the temperature stored in Tnc [98] is moved to Tnc [99] and the newly detected temperature is stored in Tnc [0].

The control unit 1 serving as the temperature calculation section uses the temperatures detected for every unit of time to calculate the correction values for every occasion where the surface temperature of the fixing roller 6*b* is detected. The following is an explanation of the method for calculating the correction values, with t representing units of time and n representing the number of spaces divided by the noncontact thermistor detected temperature storage unit 25.

First, an explanation is given concerning the amount of change in the temperature of the thermosensitive film 6*fa*2 (Tnc) detected by the noncontact thermistor element 6*fa*3 at a prescribed time T. This amount of change in temperature of the thermosensitive film 6*fa*2 at the prescribed time T (dTnc/dT) can be calculated by the noncontact thermistor detected temperature storage unit 25 from the temperature stored in each divided space for every unit of time. In a case where the amount of temperature change is calculated from the previous prescribed time T to the current prescribed time T, the temperature detected at the previous prescribed time T is stored in Tnc [n−1] of the noncontact thermistor detected temperature storage unit 25. The temperature detected at the current prescribed time T is stored in Tnc [0] of the noncontact thermistor detected temperature storage unit 25. With the aforementioned temperatures set at Tnc [n−1] and Tnc [0] respectively, the amount of change in temperature of the thermosensitive film 6*fa*2 at the prescribed time T (dTnc/dT) can be calculated using Equation 5 shown below. In addition, the prescribed time T is the time used as a standard for every calculation of the amount of change in the temperature of the thermosensitive film 6*fa*2, is a time that is equal to, or a whole number multiple of, the unit of time t measured by the time measurement unit 20, and is not limited in any particular way. Further, the prescribed time T is calculated as the product of the unit of time t and the number of spaces n divided by the noncontact thermistor detected temperature storage unit 25.

[Equation 5]

$$(dTnc/dT)=(Tnc[n-1]-Tnc[0])/n\times t \qquad \text{Equation 5}$$

Figure 18:
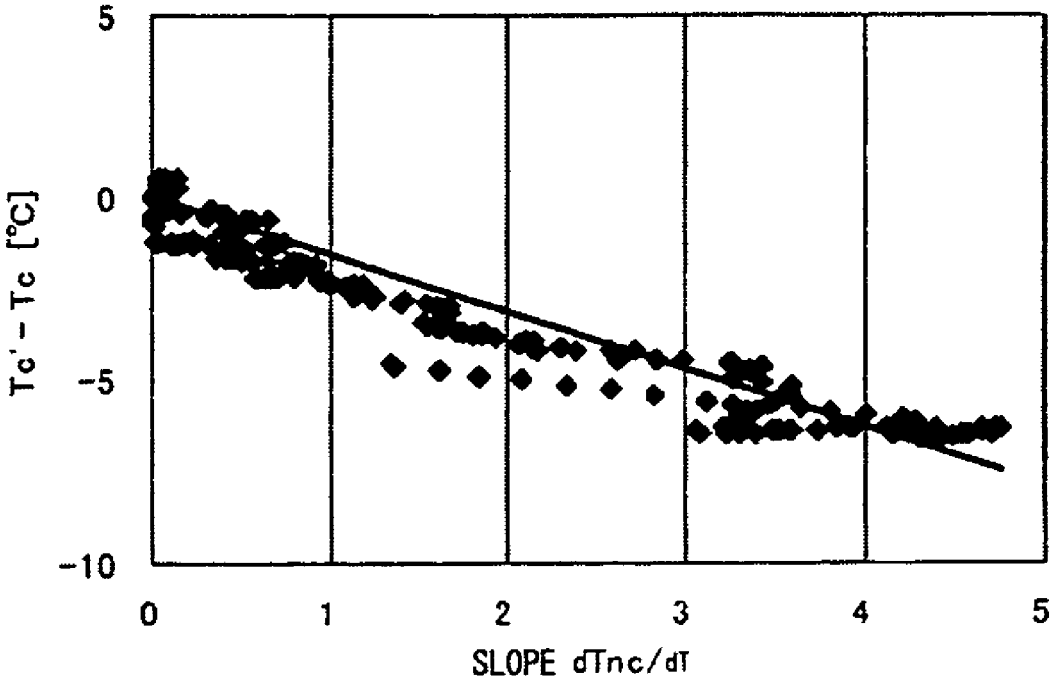
FIG. 18 is a diagram showing the correlative relationship between the amount of temperature change in the thermosensitive film at the prescribed time and the difference of the actual surface temperature of the fixing roller and the calculated surface temperature of the fixing roller in the image forming apparatus of the second embodiment.

Using a fixing roller that is the same as the actual fixing roller 6*b* used in the image forming apparatus of the present invention, the relationship between the amount of temperature change of the thermosensitive film 6*fa*2 at the prescribed time T (dTnc/dT) and the difference between the actual surface temperature of the fixing roller 6*b* (Tc) and the surface temperature of the fixing roller 6*b* calculated using Equation 2 explained in the first embodiment (Tc') is shown in FIG. 18. From this graph, it is recognized that there is a strong correlative relationship between the amount of temperature change of the thermosensitive film 6*fa*2 at the prescribed time T (dTnc/dT) and the difference between the actual surface temperature of the fixing roller 6*b* and the surface temperature of the fixing roller 6*b* calculated using Equation 2 explained in the first embodiment (Tc'−Tc). The approximate equation representing this relationship is shown below in Equation 6. Equation 2 is the same as Equation 2 described in the first embodiment and therefore an explanation will be omitted.

[Equation 6]

$$(Tc'-Tc)=D\times(dTnc/dT) \quad \text{Equation 6}$$

In other words, the error in the detection of the surface temperature of the fixing roller 6*b* arising from the delay in heat transfer caused by the separation of the fixing roller 6*b* and the temperature detection unit 6 is shown as the product of the constant D and the amount of temperature change of the thermosensitive film 6*fa*2 at the prescribed time T (dTnc/dT). Tc' is found from Equation 2, described in the first embodiment. Accordingly, the surface temperature of the fixing roller 6*b* can be calculated by Equation 7, shown below, in which D X (dTnc/dT) has been subtracted from the right side of Equation 2. The D X (dTnc/dT) becomes the correction value calculated based on the amount of temperature change at the prescribed time T.

[Equation 7]

$$Tc=A\times Tnc+B\times Tamb+C-D\times(dTnc/dT) \quad \text{Equation 7}$$

A, B, and C are calculated in the same manner as in Equations 1 and 2 of the first embodiment. The D of Equations 6 and 7 can be calculated from the slope of the approximate equation derived from the correlative graph shown in FIG. 18. The correction values A, B, C, and D can be, for example, 1.45, −0.45, 0.00, and 1.20 respectively. The calculated correction values A, B, C, and D are previously calculated and held in the control unit 1. Using the correction values A, B, C, and D, the control unit 1 can accurately calculate the surface temperature of the fixing roller 6*b* from the temperature of the thermosensitive film 6*fa*2 detected by the noncontact thermistor element 6*fa*3, the temperature of the holding unit 6*fa*1 detected by the compensating thermistor element 6*fb*2, and the amount of temperature change of the thermosensitive film 6*fa*2 at the prescribed time T. The correction values A, B, C, and D are determined by experimentation for every model of the image forming apparatus, so that different models have different values.

Figure 19:
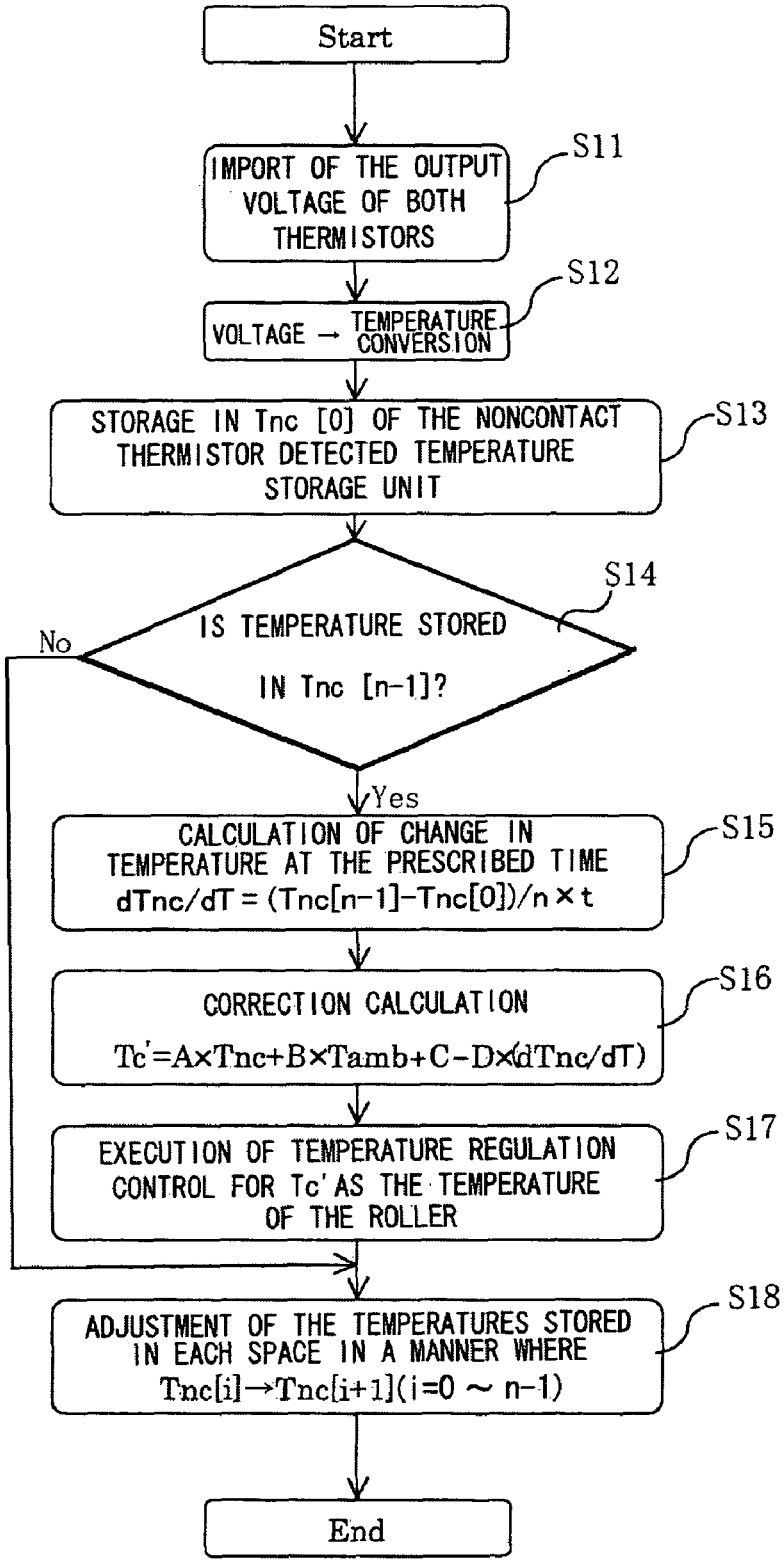
FIG. 19 is a flow chart showing the regulation of the surface temperature of the fixing roller by the control unit in the image forming apparatus of the second embodiment.

The control unit 1 holding the correction values regulates the surface temperature of the fixing roller 6*b* to an appropriate level in the manner described below. The following is an explanation concerning the regulation method of the surface temperature of the fixing roller 6*b* using FIG. 19.

The control unit 1 executes the following process upon reception of the printing data. In addition, this process is executed for every instance of temperature detection by the thermistor element. First, as shown in step S11, the control unit 1 detects and reads the value of the output voltage of the compensating thermistor element 6*fb*2 and the noncontact thermistor element 6*fa*3 at the voltage detection points Vout1 and Vout2 of the temperature detection circuit 19. The control unit 1 then converts this output voltage into temperature as shown in step S12 and detects the temperature of the compensating thermistor element 6*fb*2 and the noncontact thermistor element 6*fa*3. Because the detected voltage changes according to the temperature of the compensating thermistor element 6*fb*2 and the noncontact thermistor element 6*fa*3, the temperature of the compensating thermistor element 6*fb*2 and the noncontact thermistor element 6*fa*3 can be calculated from the detected output voltage.

The temperature detected by the noncontact thermistor element 6*fa*3 is the temperature of the thermosensitive film 6*fa*2 (Tnc). The temperature detected by the compensating thermistor element 6*fb*2 is the temperature of the holding unit 6*fa*1 (Tamb). As shown in step S13, the control unit 1 stores the temperature detected by the noncontact thermistor element 6*fa*3 in Tnc [0] of the prescribed number of divided spaces of the noncontact thermistor detected temperature storage unit 25. The temperature of the thermosensitive film 6*fa*2 detected at the previous prescribed time T is stored in Tnc [n−1] of the nth space of the noncontact thermistor detected temperature storage unit 25. As shown in step S14, the control unit 1 then makes a judgment as to whether the temperature detected at the previous prescribed time T is stored in Tnc [n−1]. In a case where the temperature is not stored in Tnc [n−1], the control unit 1 proceeds to step S18.

On the other hand, in a case where the temperature is stored in Tnc [n−1] at step S14, the control unit 1, using Equation 5, calculates the amount of temperature change detected by the noncontact thermistor element 6*fa*3 at the prescribed time T from the Tnc [n−1] temperature detected by the noncontact thermistor element 6*fa*3 at the previous prescribed time T and the Tnc [0] temperature detected by the noncontact thermistor element 6*fa*3 at the current prescribed time T, as shown in step S15. In other words, the control unit 1 calculates the amount of temperature change of the thermosensitive film 6*fa*2 at the prescribed time T.

The control unit 1, using the formula shown in Equation 7, calculates the surface temperature of the fixing roller 6*b* (Tc') from the held correction values A, B, C, and D, the temperatures detected by the noncontact thermistor element 6*fa*3 and the compensating thermistor element 6*fb*2, and the amount of temperature change detected by the noncontact thermistor element 6*fa*3 at the prescribed time T, as shown in step 516.

Using the calculated Tc', the control unit 1 regulates the surface temperature of the fixing roller 6*b* as shown in step S17. The control unit 1 sends a command to the power distribution supply unit 16 connected to the fixing heater 6*a* inside the fixing roller 6*b*, to turn on or turn off the fixing heater 6*a*. The power distribution control unit 16 receives the command and turns on or turns off the fixing heater 6*a*, thereby regulating the surface temperature of the fixing roller 6*b*.

The control unit 1 then adjusts the temperature stored in each divided space of the noncontact thermistor detected temperature storage unit 25 in a manner such that Tnc [i] becomes Tnc [i+1], as shown in step S18. At this time, i represents the range from 0 to n−1. After completing step S18, the control unit 1 finishes the process. The control unit 1 repeats the string of processes for every instance of temperature detection by the thermistor element, so that the temperature for fusing the toner to the medium 12 can be regulated to an appropriate level.

Figure 20:
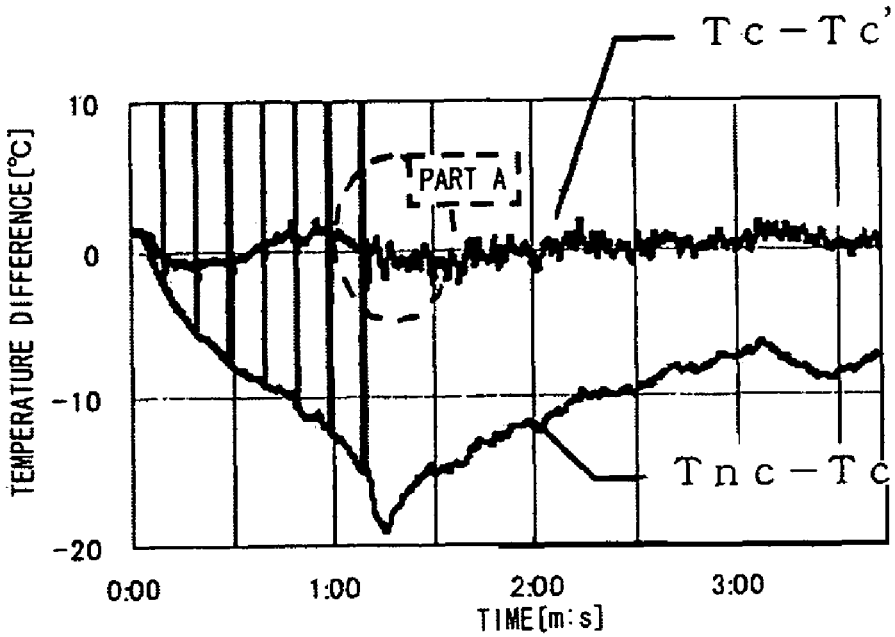
FIG. 20 is a diagram showing the difference between the calculated surface temperature of the fixing roller and the actual temperature of the fixing roller in the image forming apparatus of the second embodiment.

The difference between the actual surface temperature of the fixing roller 6*b* (Tc) and the calculated surface temperature of the fixing roller 6*b* (Tc') therefore almost disappears, as shown in FIG. 20, because of the regulation of the surface temperature of the fixing roller 6*b* by the control unit 1. Even where the temperature detection unit 6*f* is separated from the fixing roller 6*b*, the error in the detected surface temperature of the fixing roller 6*b* caused by the delay in transfer of heat can be precisely corrected with the method described above.

In other words, a precise temperature can be detected using through the amount of change in temperature of the thermosensitive film 6*fa*2 at the prescribed time T and the temperatures of the thermosensitive film 6*fa*2 and the holding unit 6*fa*1.

The image forming apparatus described in the second embodiment can accurately detect the surface temperature of the fixing roller 6*b* as described above and can form an image on the medium 12 as described in the first embodiment.

Accordingly, the image forming apparatus described in the second embodiment can prevent a decrease in quality of the formed image by not scarring the surface of the fixing roller 6*b* because the fixing roller 6*b* is equipped with a noncontact temperature detection unit 6*f* for detecting the surface temperature of the fixing roller 6*b*. The delay in heat transfer to the noncontact thermistor element 6*fa*3 arising where a change occurs in the surface temperature of the fixing roller 6*b* can be dealt with by correcting the temperature detected by the noncontact thermistor element 6*fa*3 based on the amount of temperature change of the thermosensitive film 6*fa*2 at the prescribed time. In other words, the error arising from the delay in heat transfer to the noncontact thermistor element 6*fa*3 can be corrected. Accordingly, the surface temperature of the fixing roller 6*b* can be accurately detected because a correction can be made according to the temperature change in the area surrounding the fixing roller 6*b*. The toner can reliably be fused to the medium 12 since regulation of the surface temperature of the fixing roller 6*b* can be accurately executed.

In the second embodiment, the temperature regulation of the surface of the fixing roller 6*b* at the time of printing is explained in a condition where printing data is received, but, the present invention is not limited to this condition and, the same temperature regulation is possible even while warming up, that is, in a condition where the medium 12 is not fed to the photosensitive drum 8. In the fusion device 6, because heat is stolen at the passage of the medium 12, correction values A, B, C, and D that are different from the correction values A, B, C, and D at the time of printing mentioned above are sought in advance, and the control unit 1 may calculate the precise temperature of the surface of the fixing roller 6*b* by using these correction values. In the temperature detection of the fixing roller 6*b* during warm up, the control unit 1 may detect the temperature using different correction values such as, for example, 1.40, −0.40, 0.00, and 1.20 for the correction values A, B, C, and D respectively, so that the temperature of the fixing roller 6*b* can be accurately regulated.

Third Embodiment

The structure of the image forming apparatus described in the third embodiment is the same as that of the image forming apparatus described in the second embodiment. In the image forming apparatus described in the third embodiment, the correction value A of Equation 7 explained in the second embodiment focuses on the change in the surrounding temperature, that is, the temperature of the holding unit 6*fa*1 detected by the compensating thermistor element 6*fb*2. The image forming apparatus described in the third embodiment can correct the error arising from this change in temperature. In addition, the units that make up the image forming apparatus described in the third embodiment are the same as those in the first and second embodiments and therefore the same numbers will be used and an explanation will be omitted.

Figure 21:
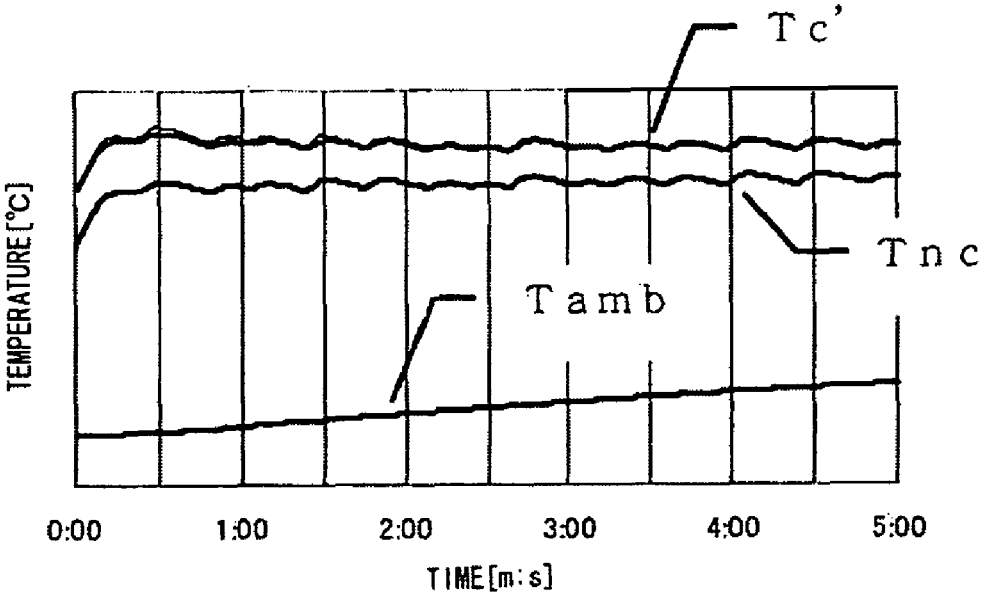
FIG. 21 is a diagram showing the relationship between the temperatures of the fixing roller, thermosensitive film, and holding unit in the image forming apparatus of the third embodiment.
Figure 22:
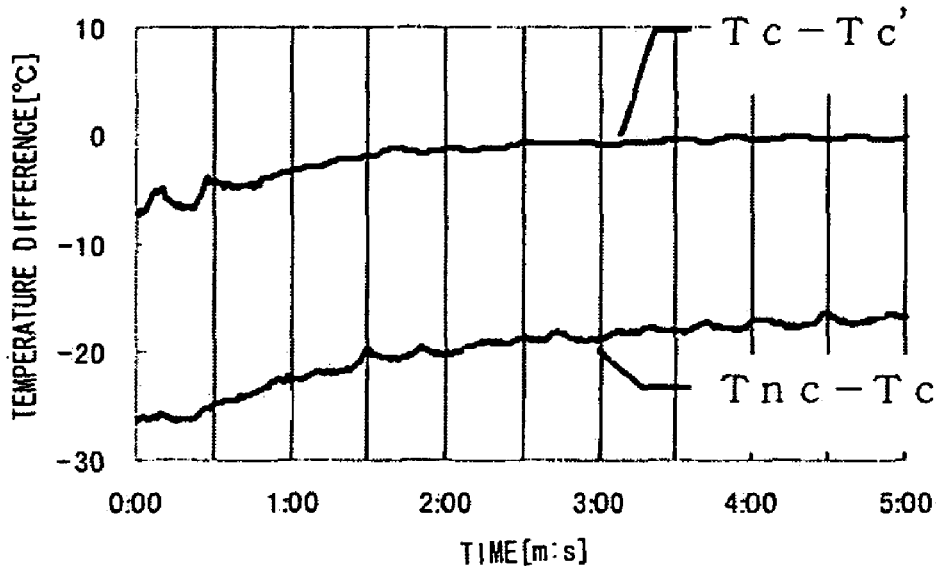
FIG. 22 is a diagram showing the difference between the actual surface temperature of the fixing roller and the calculated surface temperature of the fixing roller and the difference between the temperature of the thermosensitive film and the surface temperature of the fixing roller in the image forming apparatus of the third embodiment.

The actual surface temperature of the fixing roller 6*b* (Tc), the temperature of the thermosensitive film 6*fa*2 (Tnc) detected by the noncontact thermistor element 6*fa*3, and the temperature of the holding unit 6*fa*1 (Tamb) detected by the compensating thermistor element 6*fb*2 are as shown in FIG. 21. The difference (Tc−Tc') between the actual surface temperature of the fixing roller 6*b* (Tc) and the surface temperature of the fixing roller 6*b* calculated using Equation 7 of the second embodiment (Tc') and the difference (Tnc−Tc) between the temperature of the thermosensitive film 6*fa*2 and the actual surface temperature of the fixing roller 6*b*, have a relationship as shown in FIG. 22. It is recognized from this that where the difference (Tnc−Tc) between the temperature of the thermosensitive film 6*fa*2 and the actual surface temperature of the fixing roller 6*b* is large, the difference (Tc−Tc') between the actual surface temperature of the fixing roller 6*b* (Tc) and the calculated surface temperature of the fixing roller 6*b* (Tc') is also large. As explained in the first embodiment, in a case where the difference (Tnc−Tc) between the temperature of the thermosensitive film 6*fa*2 and the actual surface temperature of the fixing roller 6*b* is large, the temperature detected by the compensating thermistor element 6*fb*2 is low, showing that the temperature of the surrounding area is low. Accordingly, an error arises in the calculation of the surface temperature of the fixing roller 6*b* because the temperature of the surrounding area is low. In a case where the temperature of the surrounding area is greatly different, the thermal resistance of the space between the temperature detection unit 6*f* and the fixing roller 6*b* changes, causing a difference in the suitable correction value.

The image forming apparatus described in the third embodiment can accurately calculate the surface temperature of the fixing roller 6*b* by changing the correction value in accordance with the temperature of the surrounding area detected by the compensating thermistor element 6*fb*2.

Figure 23:
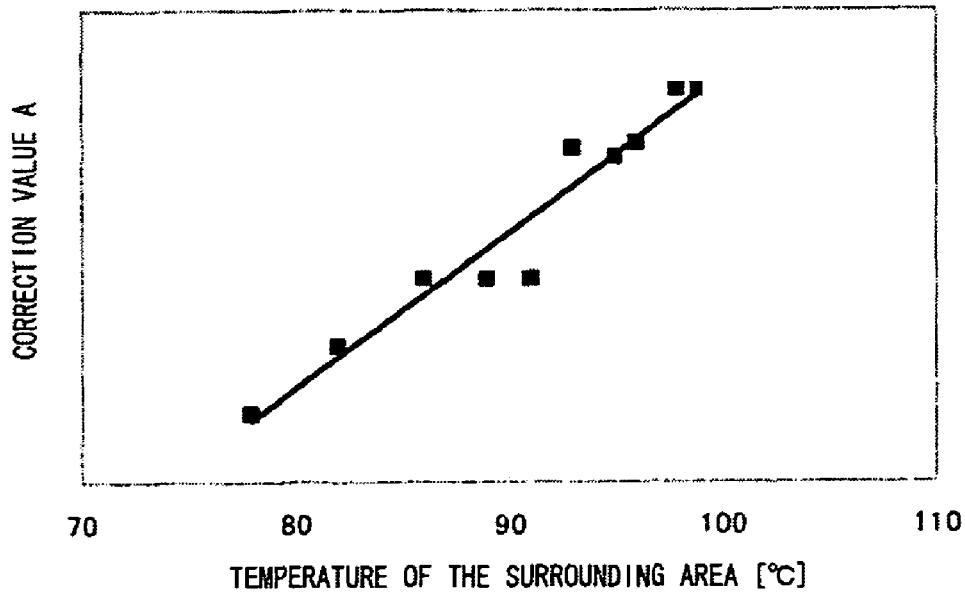
FIG. 23 is a diagram showing the correlative relationship between the correction value A and the temperature of the surrounding area in the image forming apparatus of the third embodiment.

The relationship between the correction value A used in Equation 7 and the surrounding temperature that is the temperature detected by the compensating thermistor element 6*fb*2 is shown in FIG. 23. It is recognized from this relationship that there is a strong correlative relationship between the correction value A and the temperature of the surrounding area. The approximation equation representing this relationship is shown below in Equation 8.

[Equation 8]

$$A=a\times Tamb+b \qquad \text{Equation 8}$$

The correction value A of Equation 7 has a proportional relationship with the temperature of the surrounding area (Tamb) and is a value that changes according to the temperature of the surrounding area. The correction value A can be corrected in accordance with the temperature of the surrounding area by previously finding the constants a and b. The constants a and b can be calculated using the approximation equation derived from the correlative graph shown in FIG. 23. The constants a and b are found in the same manner as the correction values A, B, C, and D and are held in the control unit 1. The control unit 1, using the constants a and b, calculates A[Tamb], the value corrected by the correction value A, from the temperature detected by the compensating thermistor unit 6*fb*2. Substituting A[Tamb] for A in Equation 7 results in Equation 9 shown below. The constants a and b are determined by experimentation for every model of the image forming apparatus, so that different models have different values. For example, in a different model, the values for the constants a and b can be 0.33 and 1.10 respectively.

[Equation 9]

$$Tc=A[Tamb]\times Tnc+B\times Tamb+C-D\times(dTnc/dT) \qquad \text{Equation 9}$$

Using the correction values A[Tamb], B, C, and D, the control unit 1 can accurately calculate the surface temperature of the fixing roller 6*b* from the temperature detected by the noncontact thermistor element 6*fa*3, the temperature detected by the compensating thermistor element 6*fb*2, and the amount of change in the temperature of the thermosensitive film 6*fa*2 at the prescribed time T.

Figure 24:
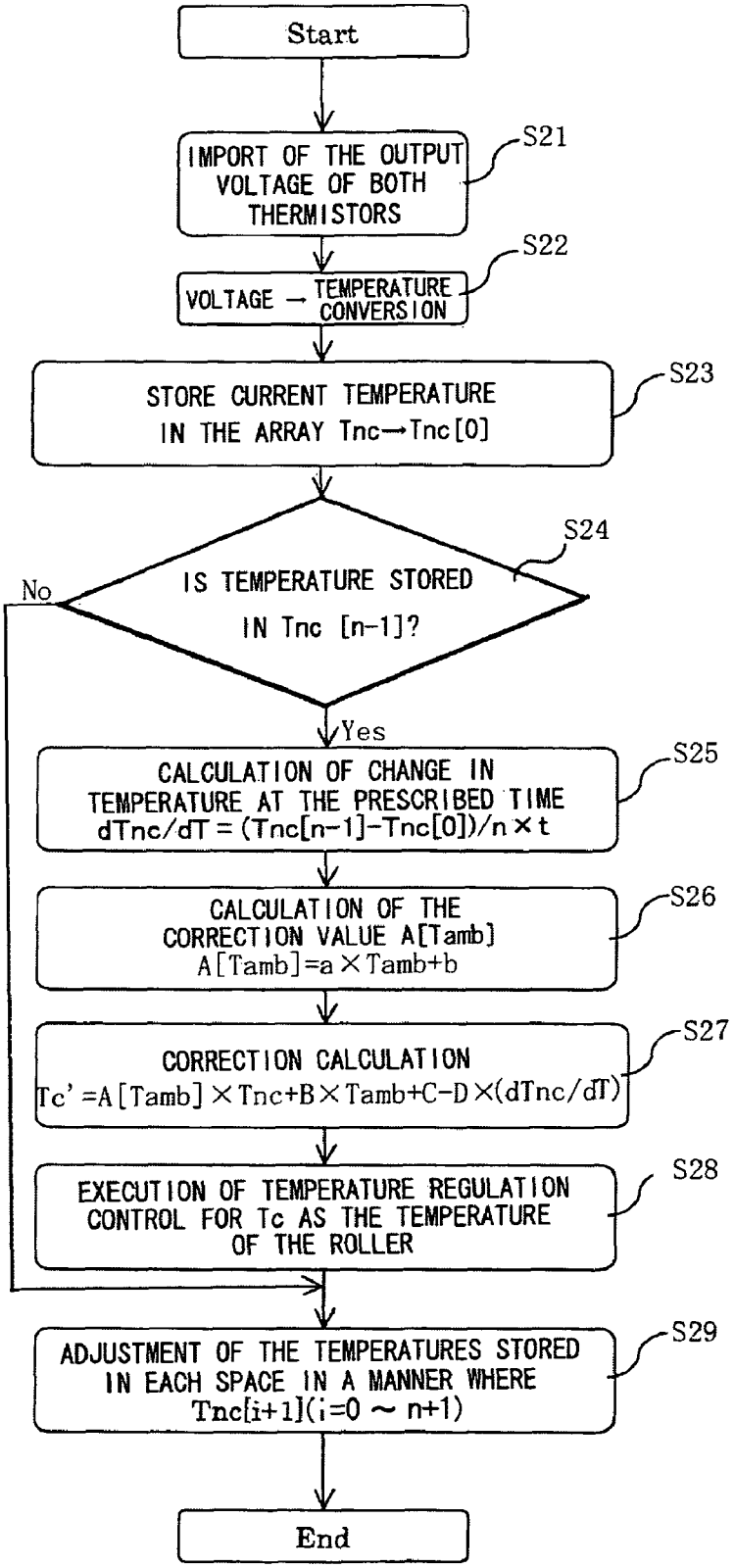
FIG. 24 is a flow chart showing the regulation of the surface temperature of the fixing roller by the control unit in the image forming apparatus of the third embodiment.

The control unit 1 holding the correction values regulates the surface temperature of the fixing roller 6*b* to an appropriate level in the manner described below. The following is an explanation concerning the regulation method of the surface temperature of the fixing roller 6*b* using FIG. 24.

The control unit 1 executes the following process upon reception of the printing data. In addition, this process is executed for every instance of temperature detection by the thermistor element. First, as shown in step S21, the control unit 1 detects and reads the value of the output voltage of the compensating thermistor element 6*fb*2 and the noncontact thermistor element 6*fa*3 at the voltage detection points Vout1 and Vout2 of the temperature detection circuit 19. The control unit 1 then converts this output voltage into temperature as shown in step S22 and detects the temperature of the compensating thermistor element 6*fb*2 and the noncontact thermistor element 6*fa*3. Because the detected voltage changes according to the temperature of the compensating thermistor element 6*fb*2 and the noncontact thermistor element 6*fa*3, the temperature of the compensating thermistor element 6*fb*2 and the noncontact thermistor element 6*fa*3 can be calculated from the detected output voltage.

The temperature detected by the noncontact thermistor element 6*fa*3 is the temperature of the thermosensitive film 6*fa*2 (Tnc). The temperature detected by the compensating thermistor element 6*fb*2 is the temperature of the holding unit 6*fa*1 (Tamb). As shown in step S23, the control unit 1 stores the temperature detected by the noncontact thermistor element 6*fa*3 in Tnc [0] of the prescribed number of divided spaces of the noncontact thermistor detected temperature storage unit 25. The temperature of the thermosensitive film 6*fa*2 detected at the previous prescribed time T is stored in Tnc [n−1] of the nth space of the noncontact thermistor detected temperature storage unit 25. As shown in step S24, the control unit 1 then makes a judgment as to whether the temperature detected at the previous prescribed time T is stored in Tnc [n−1]. In a case where the temperature is not stored in Tnc [n−1], the control unit 1 proceeds to step S29.

On the other hand, in a case where the temperature is stored in Tnc [n−1] at step S24, the control unit 1, using Equation 5, calculates the amount of temperature change detected by the noncontact thermistor element 6*fa*3 at the prescribed time T from the Tnc [n−1] temperature detected by the noncontact thermistor element 6*fa*3 at the previous prescribed time T and the Tnc [0] temperature detected by the noncontact thermistor element 6*fa*3 at the current prescribed time T, as shown in step S25. In other words, the control unit 1 calculates the amount of temperature change of the thermosensitive film 6*fa*2 at the prescribed time T.

After calculating the amount of change in temperature of the thermosensitive film 6*fa*2 at the prescribed time T, the control unit 1 corrects the correction value A[Tamb] based on the previously acquired correction value A of Equation 8, using the previously calculated constants a and b and the temperature detected by the compensating thermistor 6*fb*2, as shown in step S26.

The control unit 1, using the formula shown in Equation 9, calculates the surface temperature of the fixing roller 6*b* (Tc') from the correction value A[Tamb] calculated at step S26, the held correction values A, B, C, and D, the temperatures detected by the noncontact thermistor element 6*fa*3 and the compensating thermistor element 6*fb*2, and the amount of temperature change detected by the noncontact thermistor element 6*fa*3 at the prescribed time T, as shown in step S27.

Using the calculated Tc', the control unit 1 regulates the surface temperature of the fixing roller 6*b* as shown in step S28. The control unit 1 sends a command to the power distribution supply unit 16 connected to the fixing heater 6*a* inside the fixing roller 6*b* to turn on or turn off the fixing heater 6*a*. The power distribution control unit 16 receives the command and turns on or turns off the fixing heater 6*a*, thereby regulating the surface temperature of the fixing roller 6*b*.

The control unit 1 then adjusts the temperature stored in each divided space of the noncontact thermistor detected temperature storage unit 25 in a manner such that Tnc [i] becomes Tnc [i+1], as shown in step S29. At this time, i represents the range from 0 to n−1. After completing step S29, the control unit 1 finishes the process. The control unit 1 repeats the string of processes for every instance of temperature detection by the thermistor element, so that the temperature for fusing the toner to the medium 12 can be regulated to an appropriate level.

Figure 25:
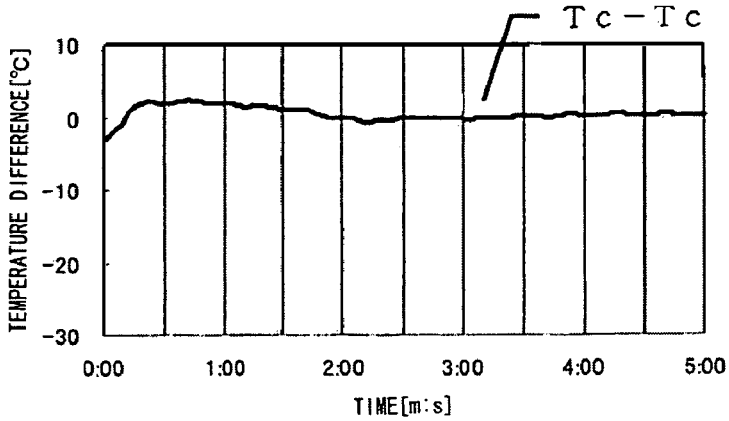
FIG. 25 is a diagram showing the difference between the calculated surface temperature of the fixing roller and the actual temperature of the fixing roller in the image forming apparatus of the third embodiment.

The image forming apparatus described in the third embodiment, using the control unit 1, changes the value of the correction value A in accordance with the temperature of the surrounding area, that is, the temperature detected by the compensating thermistor element 6*fb*2, in the manner described above. In a case where the temperature of the surrounding area is low or the like, undergoing a large temperature change and changing the thermal resistance of the space between the temperature detection unit 6*f* and the fixing roller 6*b*, or even where an error is likely to arise in calculating the surface temperature of the fixing roller 6*b*, there is almost no difference between the actual surface temperature of the fixing roller 6*b* (Tc) and the calculated surface temperature of the fixing roller 6*b* (Tc'), as shown in FIG. 25. Correction is possible according to the condition of the temperature of the surrounding area by changing the correction values in accordance with the temperature of the surrounding area. Accordingly, the surface temperature of the fixing roller 6*b* can be accurately detected.

The image forming apparatus described in the third embodiment accurately detects the surface temperature of the fixing roller 6*b* as described above and forms the image on the medium as explained in the first embodiment, The image forming apparatus described in the third embodiment can prevent a decrease in quality of the formed image by not scarring the surface of the fixing roller 6*b* because the fixing roller 6*b* is equipped with a noncontact temperature detection unit 6*f* for detecting the surface temperature of the fixing roller 6*b*. Correction is possible according to the condition of the temperature of the surrounding area by changing the correction values in accordance with the temperature of the surrounding area. Accordingly, the surface temperature of the fixing roller 6*b* can be accurately detected. The toner can reliably be fused to the medium 12 since regulation of the surface temperature of the fixing roller 6*b* can be accurately executed.

The image forming apparatus described in the third embodiment is described using the correction value A, but the present invention is not limited to this. Correction can be made in the same manner using the correction values B, C, and D and the temperature of the surrounding area, that is, the temperature detected by the compensating thermistor element 6*fb*2, so that correction is possible according to the temperature of the surrounding area, thereby allowing accurate calculation of the surface temperature of the fixing roller 6*b*. In addition, the amount of temperature change in the thermosensitive film 6*fa*2 at the prescribed time can be corrected by the surrounding temperature because the correction value D is corrected by the temperature of the surrounding area. Further, the amount of temperature change in the thermosensitive film at the prescribed time and the surrounding area may be found and corrected in the same manner as the correction of the correction value A explained in the third embodiment.

In the third embodiment, the temperature regulation of the surface of the fixing roller 6*b* at the time of printing is explained in a condition where printing data is received, but, the present invention is not limited to this condition and, the same temperature regulation is possible even while warming up, that is, in a condition where the medium 12 is not fed to the photosensitive drum 8. In the fusion device 6, because heat is stolen at the passage of the medium 12, constants a and b that are different from the constants a and b at the time of printing mentioned above are sought in advance, and the control unit 1 may calculate the correction value A[Tamb] using the constants a and b, and then calculate the precise temperature of the surface of the fixing roller 6*b* by using the correction values A[Tamb], B, C, and D. In the temperature detection of the fixing roller 6*b* during warm up, the control unit 1 may calculate the correction value A[Tamb] for the correction value A using different correction values such as, for example, 0.00 and 1.40 for the constants a and b respectively. The correction values for A[Tamb], B, C, and D therefore become 1.40, −0.40, 0.00, and 1.20 respectively and the temperature may be detected using these correction values, which are different from the correction values at the time of printing, so that the temperature of the fixing roller 6*b* can be accurately regulated.

Fourth Embodiment

The structure of the image forming apparatus described in the fourth embodiment is the same as that of the image forming apparatus described in the first embodiment. The image forming apparatus described in the fourth embodiment focuses on the decrease in temperature of the surrounding area of the thermosensitive film 6*fa*2 because of the flow of air inside the fusion device 6 caused by the rotation of the fixing roller 6*b*. The image forming apparatus described in the fourth embodiment can correct the error arising from the decrease in the temperature of the surrounding area. In addition, the units forming the image forming apparatus described in the fourth embodiment are the same as those in the first through third embodiments, and therefore the same numbers will be used and the explanation will be omitted.

Figure 26:
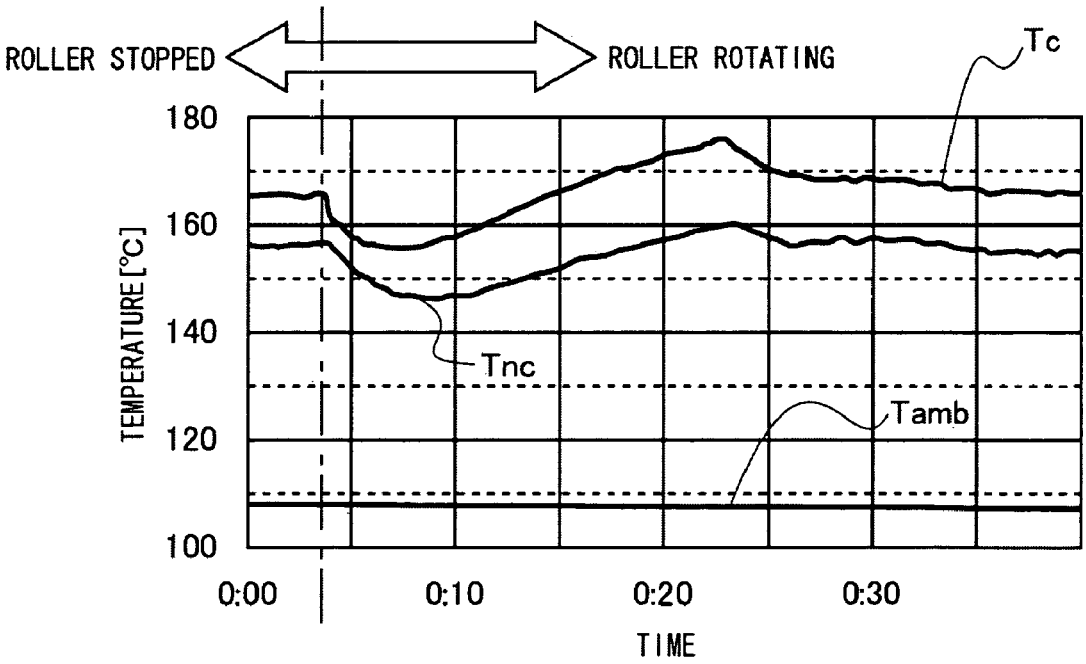
FIG. 26 is a diagram showing the relationship between the temperature of the carrying unit, the temperature of the temperature of the thermosensitive film, and the surface temperature of the fixing roller at the period where the fixing roller is rotating and the period where the fixing roller is stopped in the image forming apparatus of the fourth embodiment.
Figure 27:
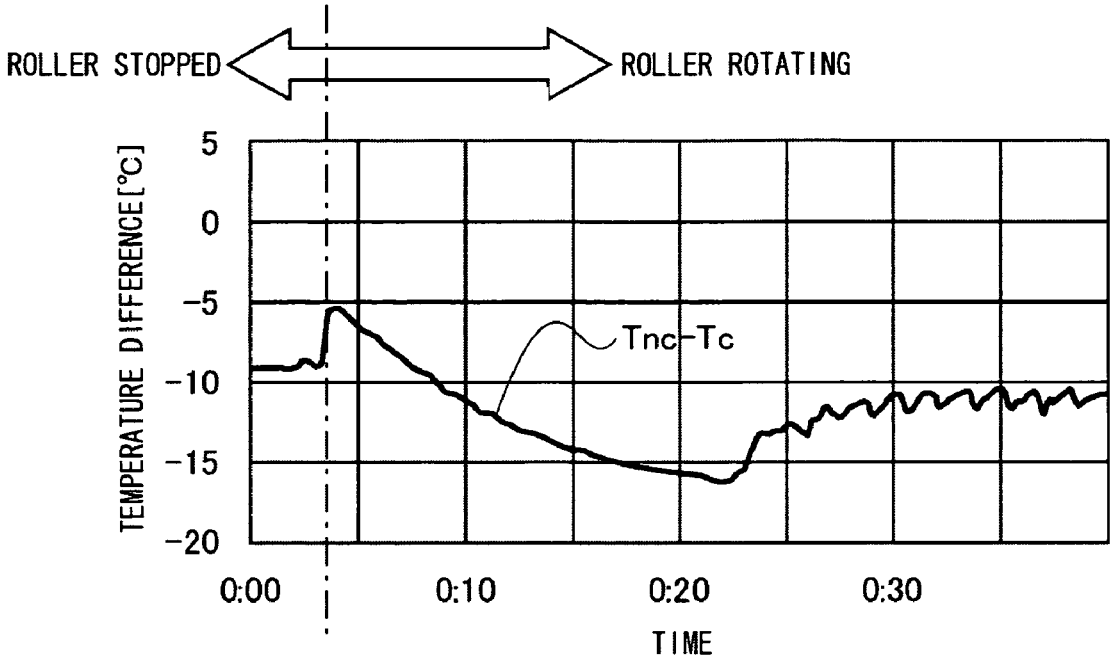
FIG. 27 is a diagram showing the relationship between the difference of the temperature of the thermosensitive film and the surface temperature of the fixing roller at the period where the fixing roller is rotating and the period where the fixing roller is stopped in the image forming apparatus of the fourth embodiment.

The actual surface temperature of the fixing roller 6*b* (Tc), as shown in FIG. 26, decreases because of the rotation of the fixing roller 6*b*. As shown in FIG. 27, the difference between the actual surface temperature of the fixing roller 6*b* (Tc) and the temperature of the thermosensitive film 6*fa*2 detected by the noncontact thermistor element 6*fa*3 (Tnc) is different at the period where the fixing roller 6*b* is rotating and the period where the fixing roller is stopped. In other words, if the correction value used when the fixing roller 6*b* is rotating is also used when the fixing roller 6*b* is stopped, an error arises in the actual surface temperature of the fixing roller 6*b*. Because the fixing roller 6*b* and the temperature unit 6*f* are separated, and because of the flow of air inside the fusion device 6 caused by the rotation of the fixing roller 6*b*, the temperature of the surrounding area decreases and there is a large amount of heat discharge.

The image forming apparatus described in the fourth embodiment can accurately calculate the surface temperature of the fixing roller 6*b* by previously seeking the correction value used when the fixing roller 6*b* is rotating and the correction value used when the fixing roller 6*b* is stopped and using these one of these values according to the operation condition of the fixing roller 6*b*.

Figure 28:
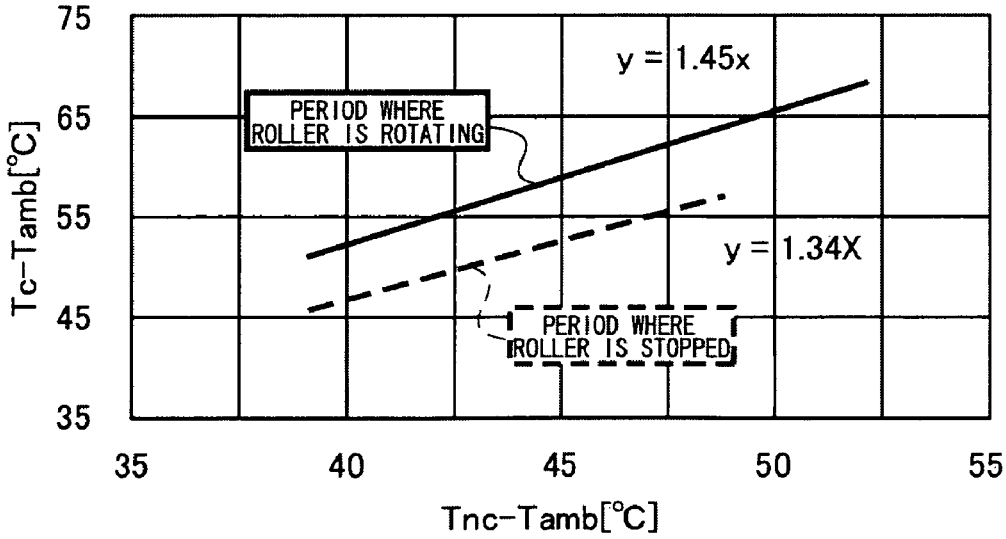
FIG. 28 is a diagram showing the relationship between the difference of the temperature of the thermosensitive film and the surface temperature of the fixing roller at the period where the fixing roller is rotating and the period where the fixing roller is stopped and the difference of the temperature of the thermal film and the temperature of the carrying unit in the image forming apparatus of the fourth embodiment.

First, the relationship between the difference of the actual surface temperature of the fixing roller 6*b* (Tc) and the temperature of the holding unit 6*fa*1 (Tamb) detected by the compensating thermistor element 6*fb*2 and the difference of the temperature of the thermosensitive film 6*fa*2 (Tnc) detected by the noncontact thermistor element 6*fa*3 and the temperature of the holding unit 6*fa*1 (Tamb) detected by the compensating thermistor element 6*fb*2 is shown in FIG. 28. In the same manner as the first embodiment, there is a strong correlative relation between the difference of the actual surface temperature of the fixing roller 6*b* (Tc) and the temperature of the holding unit 6*fa*1 (Tamb) detected by the compensating thermistor element 6*fb*2 and the difference of the temperature of the thermosensitive film 6*fa*2 (Tnc) detected by the noncontact thermistor element 6*fa*3 and the temperature of the holding unit 6*fa*1 (Tamb) detected by the compensating thermistor element 6*fb*2. The approximate equation representing this relationship is the aforementioned Equation 1 and, in the same manner as the first embodiment, this equation leads to Equation 2. With these equations, the actual surface temperature of the fixing roller 6*b* (Tc) is derivable from the relationship of the temperature of the thermosensitive film 6*fa*2 (Tnc) and the temperature of the holding unit 6*fa*1.

A, B, and C of Equation 1 and Equation 2 are separated into a time when the fixing roller 6*b* is rotating and a time when the fixing roller 6*b* is stopped, and can be derived in the same manner as in the first embodiment. For example, the correction values A, B, and C at the time when the fixing roller 6*b* is rotating can be 1.45, −0.45, and 0.00 respectively and the correction values A, B, and C at the time when the fixing roller 6*b* is stopped can be 1.34, −0.34, and 0.00 respectively. The correction values A, B, and C calculated in the manner described above are calculated in advance and held in the control unit 1. The control unit 1, using the correction values A, B, and C, can accurately calculate the surface temperature of the fixing roller 6*b* from the temperature of the holding unit 6*fa*1 detected by the compensating thermistor element 6*fb*2 and the temperature of the thermosensitive film 6*fa*2 detected by the noncontact thermistor element 6*fa*3. The correction values A, B, and C are determined by experimentation for every model of the image forming apparatus, so that different models have different values.

The control unit 1 holding the correction values regulates the surface temperature of the fixing roller 6*b* to a suitable temperature in the manner described below. The following is an explanation, using FIG. 29, of a method for regulating the surface temperature of the fixing roller 6*b*.

The control unit 1 executes the following process upon receiving the printing data. This process is executed every time temperature detection is performed by the thermistor elements. First, as shown in step S101, the control unit 1 detects and reads the value of the output voltage of the compensating thermistor element 6*fb*2 and the noncontact thermistor element 6*fa*3 at the voltage detection points Vout1 and Vout2 of the temperature detection circuit 19. The control unit 1 then converts this output voltage into temperature as shown in step S102 and detects the temperature of the compensating thermistor element 6*fb*2 and the noncontact thermistor element 6*fa*3. Because the detected voltage changes according to the temperature of the compensating thermistor element 6*fb*2 and the noncontact thermistor element 6*fa*3, the temperature of the compensating thermistor element 6*fb*2 and the noncontact thermistor element 6*fa*3 can be calculated from the detected output voltage.

The control unit 1 then, at step S103, makes a judgment as to whether the fixing roller 6*b* is rotating. In a case where the fixing roller 6*b* is rotating, the control unit 1, at step S104-1, selects the previously sought correction values A, B, and C for the time when the fixing roller 6*b* is rotating, and moves on to step S105. On the other hand, in a case where the fixing roller 6*b* is stopped at step S103, the control unit 1, at step S104-2, selects the previously sought correction values A, B, and C for the time when the fixing roller 6*b* is stopped, and moves on to step S105.

The temperature detected by the noncontact thermistor element 6*fa*3 is the temperature of the thermosensitive film 6*fa*2 (Tnc). The temperature detected by the compensating thermistor element 6*fb*2 is the temperature of the holding unit 6*fa*1 (Tamb). The control unit 1 calculates the surface temperature of the fixing roller 6*b* as shown in step S105 from the correction values A, B, and C selected at step S104-1 or S104-2 and the detected temperature of the compensating thermistor element 6*fb*2 and the noncontact thermistor element 6*fa*3 using the formula shown in aforementioned Equation 2. At this time, the calculated surface temperature of the fixing roller 6*b* is set as Tc'.

The control unit 1, as shown in step S106, controls the surface temperature of the fixing roller 6*b* using calculated surface temperature of the fixing roller 6*b* (Tc'). At this time, the control unit 1 sends a command to the power distribution control unit 16 connected to the fixing heater 6 *a* inside the fixing roller 6*b* to turn on and off the power distribution to the fixing heater 6*a*. Upon receiving this command, the power distribution control unit 16 turns on and off the power distribution to the fixing heater 6*a*, regulates the surface temperature of the fixing roller 6*b*, and finishes this process. By repeating this process, temperature for fusing the toner to the medium 12 can be regulated to an appropriate level.

Figure 29:
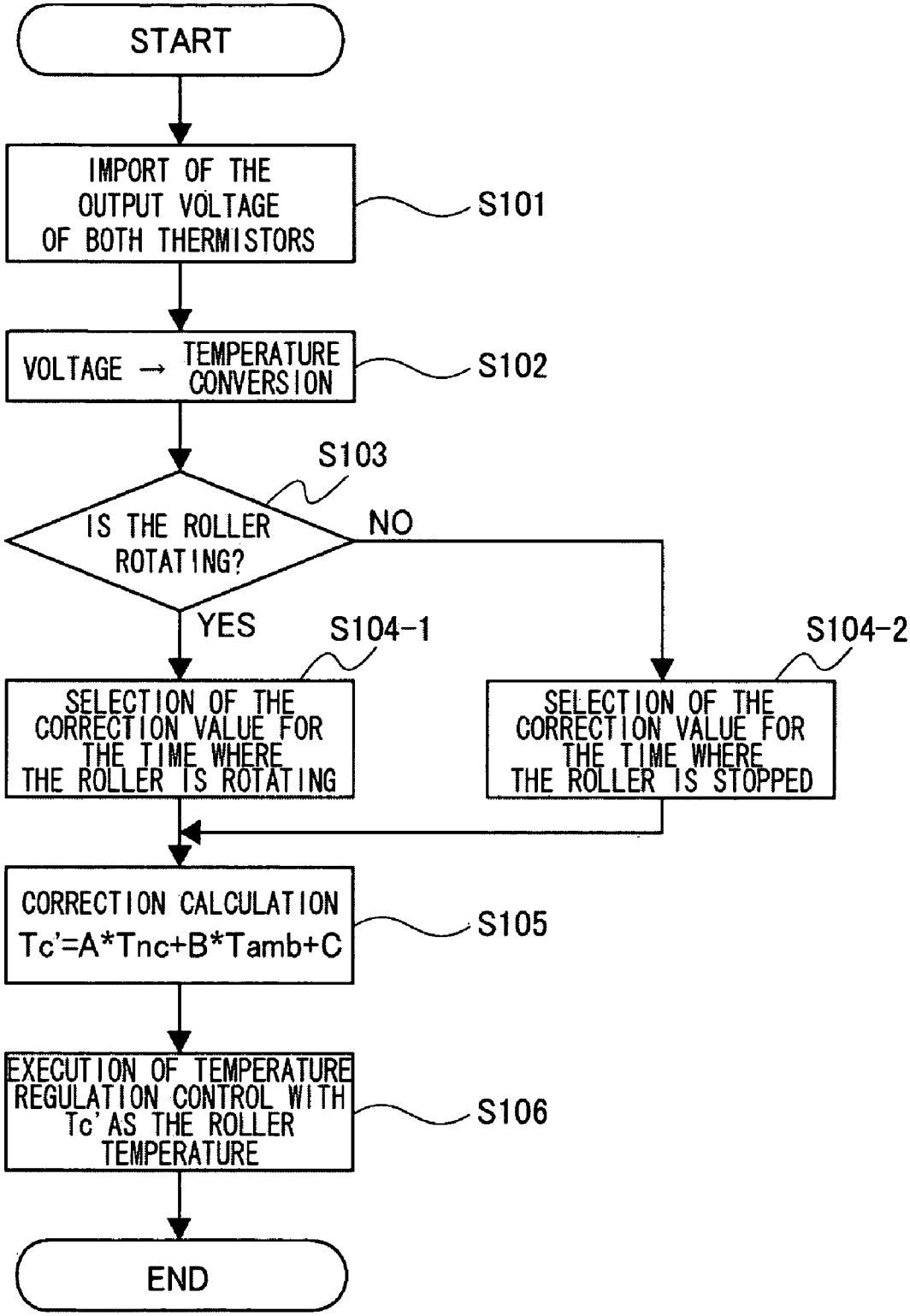
FIG. 29 is a flow chart showing the regulation of the surface temperature of the fixing roller by the control unit in the image forming apparatus of the fourth embodiment.
Figure 30:
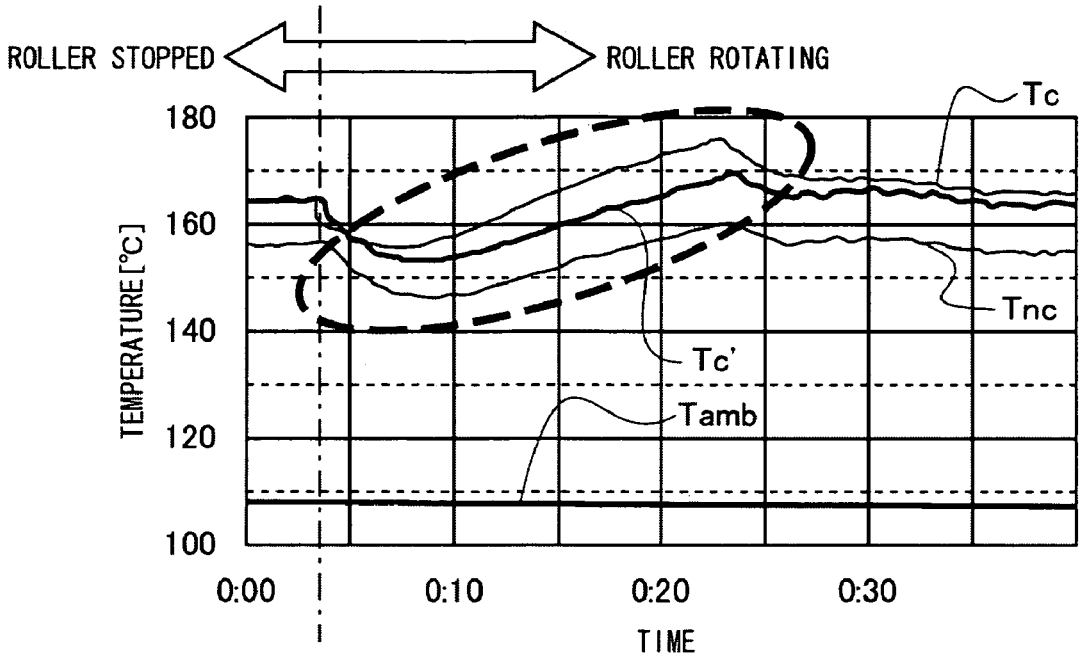
FIG. 30 is a diagram showing the relationship between the temperature of the thermosensitive film and the surface temperature of the fixing roller in a case where the temperature is regulated using correction values for the period where the fixing roller is stopped.
Figure 31:
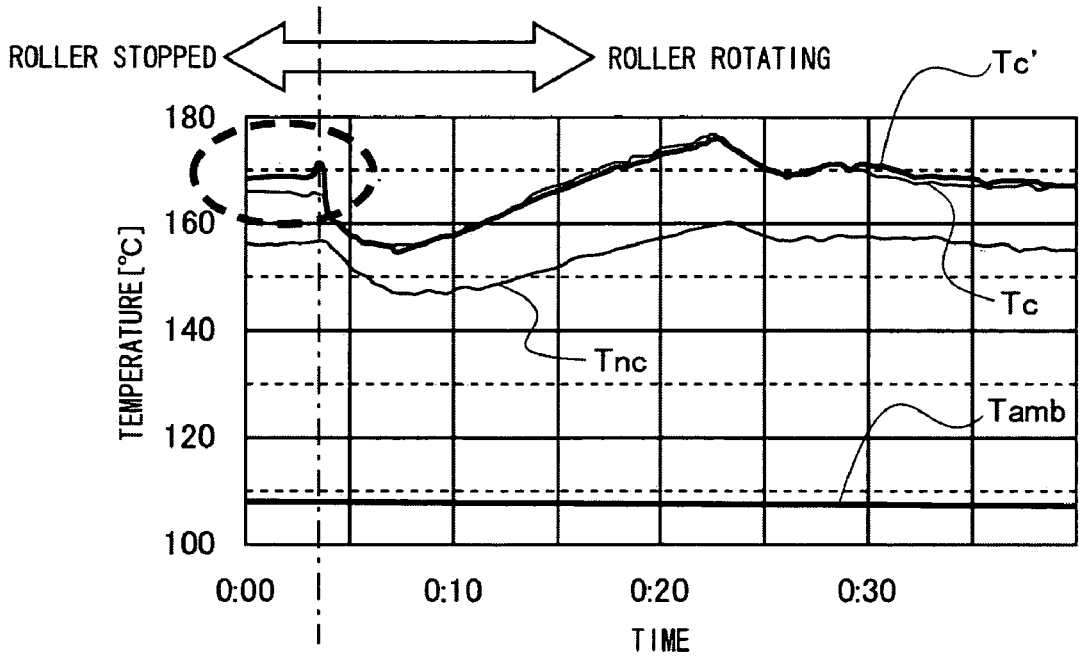
FIG. 31 is a diagram showing the relationship between the temperature of the thermosensitive film and the surface temperature of the fixing roller in a case where the temperature is regulated using correction values for the period where the fixing roller is rotating.
Figure 32:
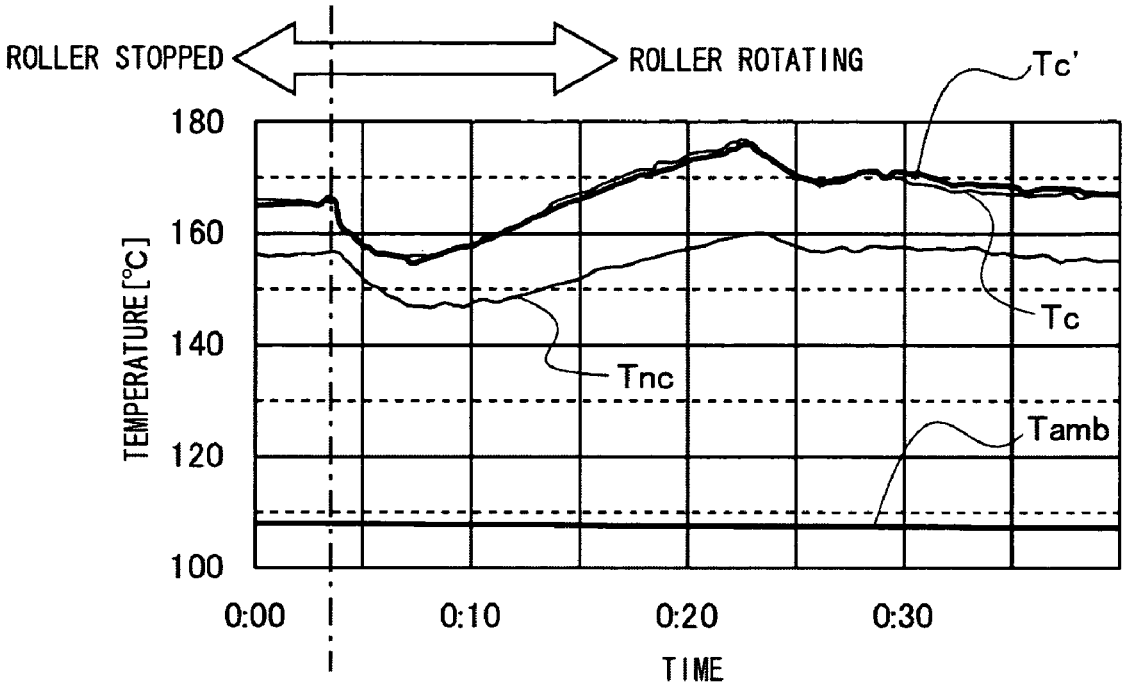
FIG. 32 is a diagram showing the relationship between the actual surface temperature of the fixing roller and the calculated surface temperature of the fixing roller in a case where the temperature is regulated using correction values for the period where the fixing roller is rotating and using correction values for the period where the fixing roller is stopped, respectively, in the image forming apparatus of the fourth embodiment.

As shown in FIG. 29, when the control unit 1 executes regulation of the surface temperature of the fixing roller 6*b*, the control unit 1 uses the correction values A, B, and C for the time when the fixing roller 6*b* is rotating in a case where the fixing roller 6*b* is rotating and uses the correction values A, B, and C for the time when the fixing roller 6*b* is stopped in a case where the fixing roller 6*b* is stopped, so that, as shown in FIG. 32, the actual surface temperature of the fixing roller 6*b* (Tc) and the calculated surface temperature of the fixing roller 6*b* (Tc') become roughly the same. Correction values corresponding to the operation condition of the fixing roller 6*b* are sought in advance and the temperature can be accurately detected because the control unit 1 uses the previously sought correction values according to the operation condition of the fixing roller 6*b*.

The image forming apparatus of the fourth embodiment calculates the surface temperature of the fixing roller 6*b* by separating the correction values A, B, and C to be used in calculating the surface temperature of the fixing roller 6*b* at a period where the fixing roller 6*b* is rotating and a period where the fixing roller 6*b* is stopped. The method using separate correction values can also be applied to the second embodiment. That is, the correction values A, B, C, and D used to calculate the surface temperature of the fixing roller 6*b* can be sought in advance, separated into a period where the fixing roller 6*b* is rotating and a period where the fixing roller 6*b* is stopped, and held in the control unit 1. For example, the correction values A, B, C, and D for the period where the fixing roller 6*b* is rotating can be 1.45, −0.45, 0.00, and 1.20 respectively. The correction values A, B, C, and D for the period where the fixing roller 6*b* is stopped can be 1.34, −0.34, 0.00, and 1.20 respectively. The control unit 1 then selects either the correction values A, B, C, and D for the period where the fixing roller 6*b* is rotating or the correction values A, B, C, and D for the period where the fixing roller 6*b* is stopped, according to the operation condition of the fixing roller 6*b*, and then calculates the surface temperature of the fixing roller 6*b* (Tc'), so that a the precise temperature can be detected.

The method using separate correction values can also be applied to the third embodiment in the same manner. That is, the correction values A[Tamb], B, C, and D used to calculate the surface temperature of the fixing roller 6*b* can be sought in advance, separated into a period where the fixing roller 6*b* is rotating and a period where the fixing roller 6*b* is stopped, and held in the control unit 1. The correction value A[Tamb] can be calculated from the correction value A and the constants a and b, in the same manner as in the third embodiment. For example, the correction values A, B, C, and D for the period where the fixing roller 6*b* is rotating can be 1.45, −0.45, 0.00, and 1.20 respectively, and the constants a and b for the period where the fixing roller 6*b* is rotating can be 0.33 and 1.10 respectively. The correction values A, B, C, and D for the period where the fixing roller 6*b* is stopped can be 1.34, −0.34, 0.00, and 1.20 respectively, and the constants a and b for the period where the fixing roller 6*b* is stopped can be 0.17 and 1.10 respectively. The correction value A[Tamb] is calculated for each of these values. The control unit 1 then selects either the constants a and b and the correction values A, B, C, and D for the period where the fixing roller 6*b* is rotating or the constants a and b and the correction values A, B, C, and D for the period where the fixing roller 6*b* is stopped, according to the operation condition of the fixing roller 6*b*, and then calculates the surface temperature of the fixing roller 6*b* (Tc'), so that a the precise temperature can be detected.

Fifth Embodiment

The structure of the image forming apparatus described in the fifth embodiment is the same as that of the image forming apparatus described in the fourth embodiment. The image forming apparatus described in the fifth embodiment focuses on a change in heat release condition in a case where image formation is executed on a medium with lesser than average width immediately after image formation. The image forming apparatus described in the fourth embodiment can correct the error arising from the decrease in the temperature of the surrounding area. In addition, the units forming the image forming apparatus described in the fifth embodiment are the same as those in the first through fourth embodiments, and therefore the same numbers will be used and the explanation will be omitted.

Figure 33:
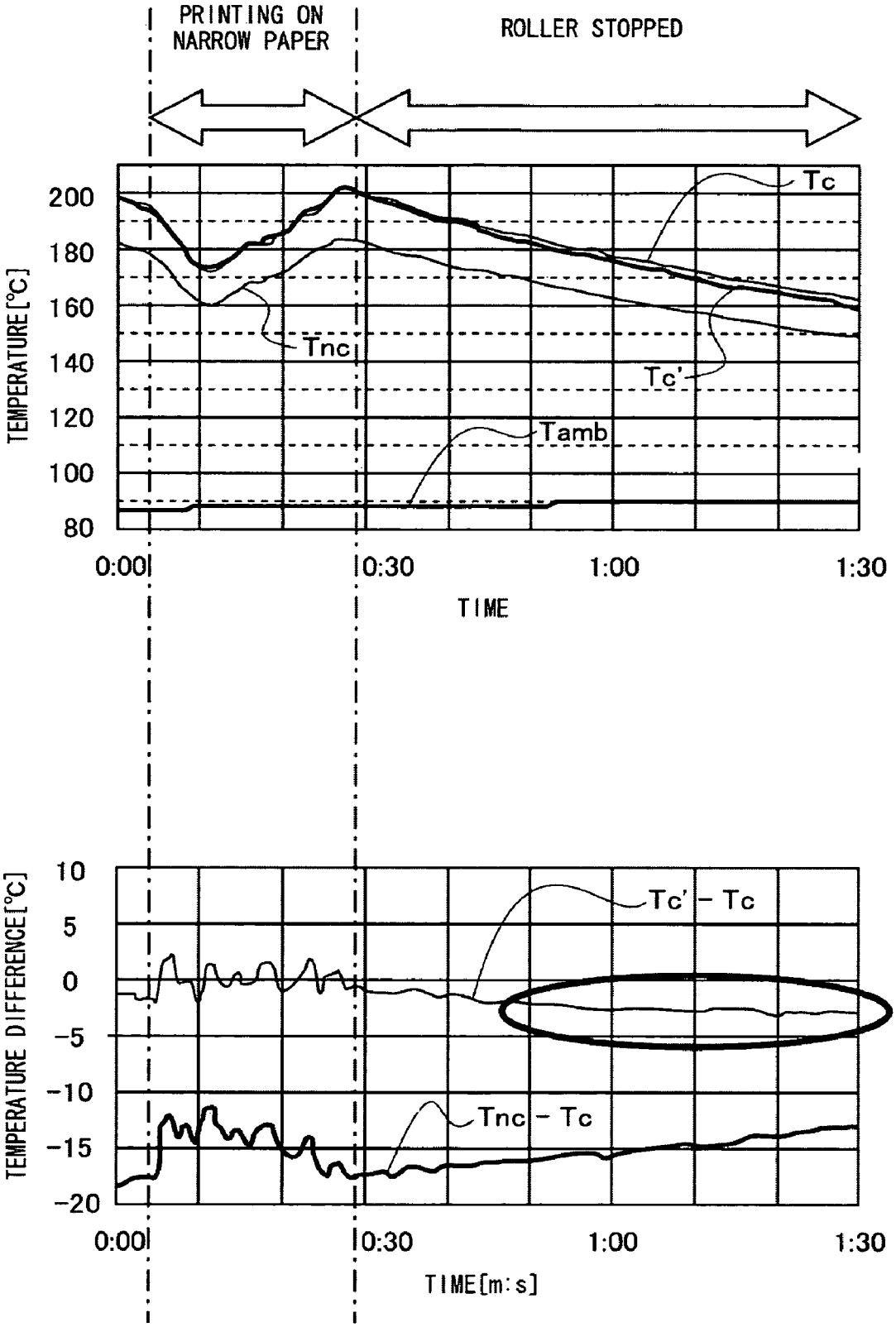
FIG. 33 is a diagram showing the relationship between the temperature of the thermosensitive film, the carrying unit, the calculated surface temperature of the fixing roller, and the actual surface temperature of the fixing roller at a time during and after the formation of the image on a narrow medium in the image forming apparatus of the fifth embodiment.

Immediately after image formation, in a case where the area of the medium 12 is less than that of the contact area of the fixing roller 6*b*, that is, a case where a medium 12 narrower than a standard medium 12 is used, the temperature of the end portions of the fixing roller 6*b* that don't contact the narrow medium increases beyond the temperature of the portion of the fixing roller 6*b* contacting the medium 12, so that the heat release condition changes because the temperature of the surrounding area of the noncontact thermistor 6*fa* increases. Further, upon completion of the printing, a difference arises between the actual surface temperature of the fixing roller 6*b* (Tc) and the calculated surface temperature of the fixing roller 6*b* (Tc') when the correction value for the period where the fixing roller 6*b* is stopped is used, as shown in FIG. 33, because the temperature does not soon return to normal after the fixing roller 6*b* stops. Accordingly, for a set period of time after the fixing roller 6*b* stops (this period of time will hereinafter be refereed to as Tw), it is necessary to use a correction value that is different from the correction value used where the fixing roller 6*b* is stopped.

The time after a narrow medium is used, within the time period Tw, is set as a prescribed operation condition of the fixing roller 6*b*, and the image forming apparatus described in the fifth embodiment previously seeks the correction values used for the condition where the fixing roller 6*b* is stopping and can accurately calculate the surface temperature of the fixing roller 6*b* by using the correction values depending on the operation condition of the fixing roller 6*b*.

In the same manner as the fourth embodiment, immediately after image formation using the narrow medium, and within the period of time Tw after completion of the image formation, the aforementioned Equation 1 and Equation 2 can be derived at the time where fixing roller 6*b* is stopped. The correction values A, B, and C for a period where the fixing roller 6*b* is stopped after printing with narrow paper, set as the secondary correction values of the aforementioned Equation 1 and Equation 2, are calculated through experimentation. For example, the correction values A, B, and C can be 1.30, −0.30, and 0.00 respectively. The correction values A, B, and C for a period where the fixing roller 6*b* is stopped after printing with a narrow paper are previously calculated and held in the control unit 1, in the same manner as the correction values for a period where the fixing roller 6*b* is rotating and the correction values for a period where the fixing roller 6*b* is stopped. Using the correction values A, B, and C, the control unit 1 can accurately calculate the surface temperature of the fixing roller 6*b* from the temperature of the thermosensitive film 6*fa*2 detected by the noncontact thermistor element 6*fa*3 and the temperature of the holding unit 6*fa*1 detected by the compensating thermistor element 6*fb*2. The correction values A, B, and C are determined by experimentation for every model of the image forming apparatus, so that different models have different values.

The control unit 1 holding the correction values regulates the surface temperature of the fixing roller 6*b* to an appropriate level in the manner described below. The following is an explanation concerning the regulation method of the surface temperature of the fixing roller 6*b* using FIG. 34.

The control unit 1 executes the following process upon receiving the printing data. This process is executed every time temperature detection is performed by the thermistor elements. First, as shown in step S201, the control unit 1 detects and reads the value of the output voltage of the compensating thermistor element 6*fb*2 and the noncontact thermistor element 6*fa*3 at the voltage detection points Vout1 and Vout2 of the temperature detection circuit 19. The control unit 1 then converts this output voltage into temperature as shown in step S202 and detects the temperature of the compensating thermistor element 6*fb*2 and the noncontact thermistor element 6*fa*3. Because the detected voltage changes according to the temperature of the compensating thermistor element 6*fb*2 and the noncontact thermistor element 6*fa*3, the temperature of the compensating thermistor element 6*fb*2 and the noncontact thermistor element 6*fa*3 can be calculated from the detected output voltage.

The control unit 1 then, at step S203, makes a judgment as to whether the fixing roller 6*b* is rotating. In a case where the fixing roller 6*b* is rotating, the control unit 1, at step S206-1, selects the previously sought correction values A, B, and C for the time when the fixing roller 6*b* is rotating, and moves on to step S207. On the other hand, in a case where the fixing roller 6*b* is stopped at step S203, the control unit 1, at step S204, makes a judgment as to whether the narrow medium is used for immediately after image formation. Immediately after image formation, in a case where the narrow medium is used, the control unit 1, at step S205, makes a judgment as to whether the current time is within the period of time Tw from the time where image formation was executed on the narrow medium, that is, from the time where the fixing roller 6*b* stopped.

At step S205, after the fixing roller 6*b* has stopped, in a case where the current time is within the period of time Tw, the control unit 1, at step S206-2, selects the previously sought correction values A, B, and C for the period where the fixing roller 6*b* is stopped after printing with the narrow paper, and moves on to step S207. At step S204, immediately after image formation, in a case where the narrow medium is not used, or at step S205, after the fixing roller 6*b* has stopped, in a case where the current time is beyond the period of time Tw, the control unit 1, at step S206-3, selects the previously sought correction values A, B, and C for the time when the fixing roller 6*b* is stopped, and moves on to step S207.

The temperature detected by the noncontact thermistor element 6*fa*3 is the temperature of the thermosensitive film 6*fa*2 (Tnc). The temperature detected by the compensating thermistor element 6*fb*2 is the temperature of the holding unit 6*fa*1 (Tamb). The control unit 1 calculates the surface temperature of the fixing roller 6*b* as shown in step S207 from the correction values A, B, and C selected at step S206-1, S206-2, or S206-3 and the detected temperature of the compensating thermistor element 6*fb*2 and the noncontact thermistor element 6*fa*3 using the formula shown in aforementioned Equation 2. At this time, the calculated surface temperature of the fixing roller 6*b* is set as Tc'.

The control unit 1, as shown in step S208, controls the surface temperature of the fixing roller 6*b* using calculated surface temperature of the fixing roller 6*b* (Tc'). At this time, the control unit 1 sends a command to the power distribution control unit 16 connected to the fixing heater 6 *a* inside the fixing roller 6*b* to turn on and off the power distribution to the fixing heater 6*a*. Upon receiving this command, the power distribution control unit 16 turns on and off the power distribution to the fixing heater 6*a*, regulates the surface temperature of the fixing roller 6*b*, and finishes this process. By repeating this process, temperature for fusing the toner to the medium 12 can be regulated to an appropriate level.

Figure 34:
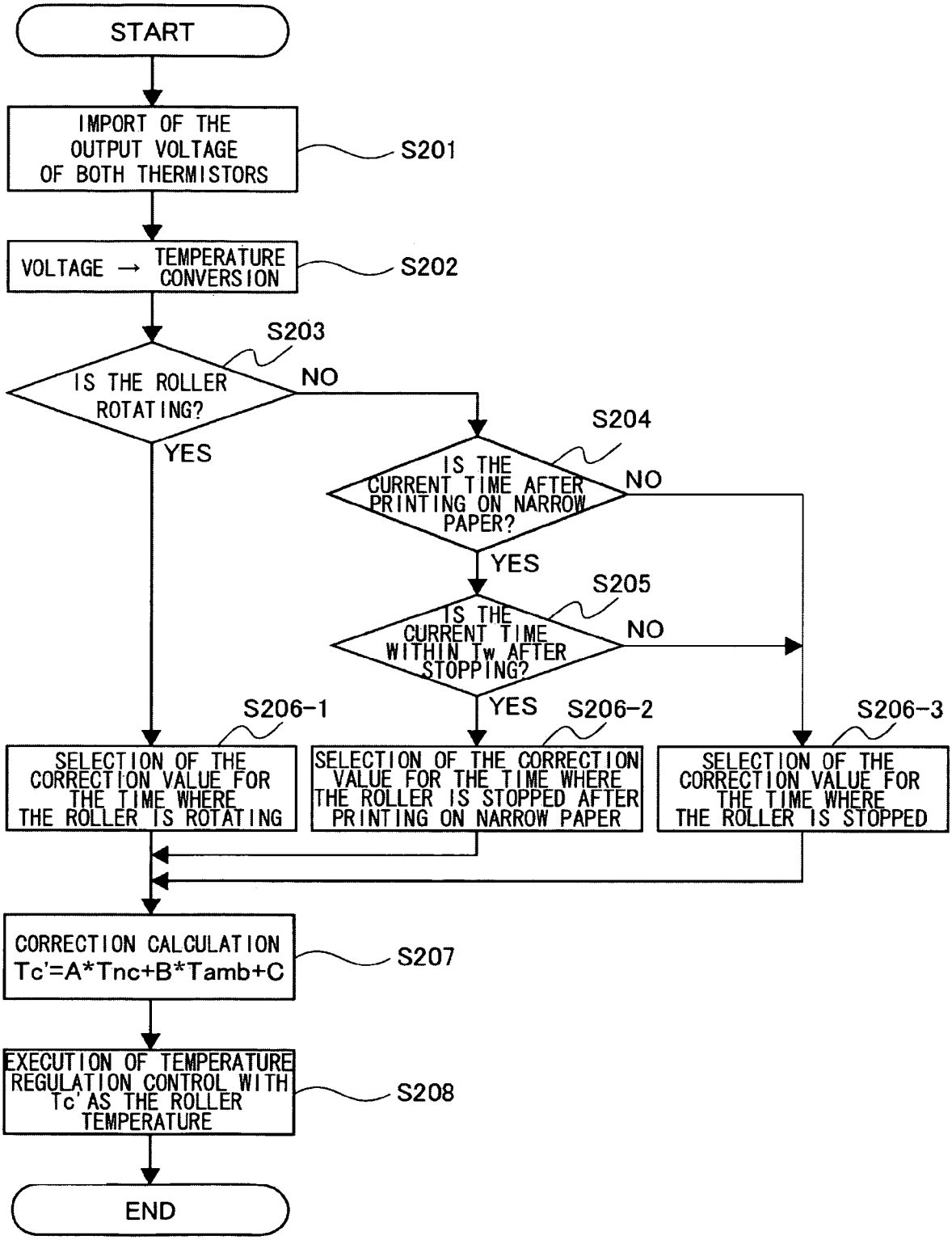
FIG. 34 is a flow chart showing the regulation of the surface temperature of the fixing roller by the control unit in the image forming apparatus of the fifth embodiment.
Figure 35:
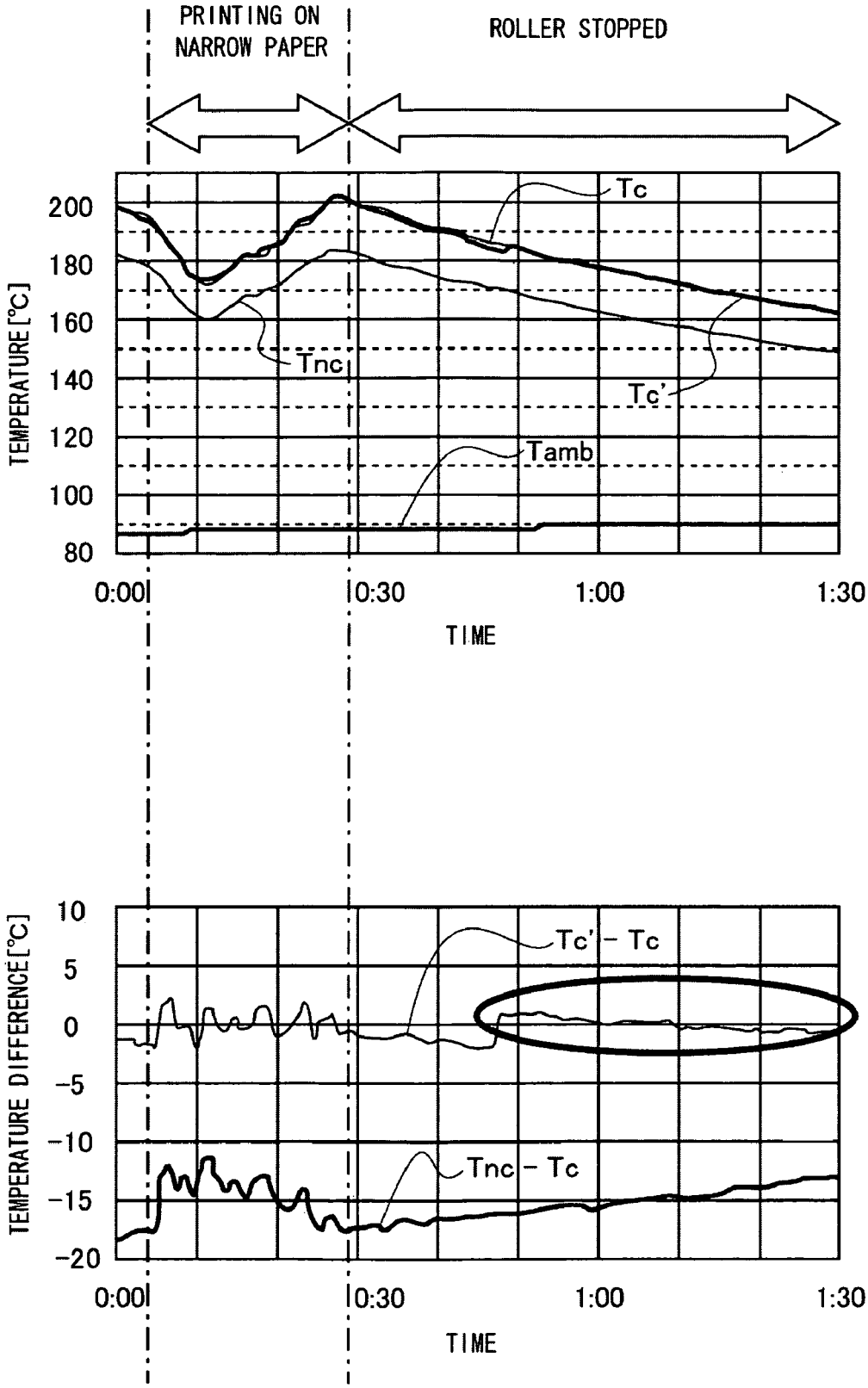
FIG. 35 is a diagram showing the relationship between the actual surface temperature of the fixing roller and the calculated surface temperature of the fixing roller in a case where the temperature is regulated using correction values for the period where the fixing roller is stopped after printing on narrow paper.

As shown in FIG. 34, when the control unit 1 executes regulation of the surface temperature of the fixing roller 6*b*, the control unit 1 uses the correction values A, B, and C for the period where the fixing roller 6*b* is stopped after printing with the narrow paper, in accordance with the operation condition of the fixing roller 6*b*, so that, as shown in FIG. 35, the actual surface temperature of the fixing roller 6*b* (Tc) and the calculated surface temperature of the fixing roller 6*b* (Tc') become roughly the same. Correction values corresponding to the operation condition of the fixing roller 6*b* are sought in advance and the temperature can be accurately detected because the control unit 1 uses the previously sought correction values according to the operation condition of the fixing roller 6*b*.

The image forming apparatus of the fifth embodiment, in addition to the correction values for the period where the fixing roller 6*b* is rotating and the period where the fixing roller 6*b* is stopped, immediately after image formation using the narrow medium, within the period of time Tw after the narrow medium is used, previously seeks the correction values A, B, and C for the period where the fixing roller 6*b* is stopped after printing on the narrow paper, serving as the secondary correction values used in for the period where the fixing roller 6*b* is stopped. These correction values are selected according to the operation condition of the fixing roller 6*b* and the surface temperature of the fixing roller 6*b* is calculated. The method described above can also be applied to the second embodiment. That is, within the time period Tw after the narrow medium is used in printing, the correction values A, B, C, and D used for calculating the surface temperature of the fixing roller 6*b* and the time where the fixing roller 6*b* stopped are sought in advance and held in the control unit 1. For example, the correction values A, B, C, and D for the period where the fixing roller is stopped after printing with the narrow paper can be 1.30, −0.30, 0.00, and 1.20 respectively. The control unit 1 then selects either the correction values A, B, C, and D for the period where the fixing roller 6*b* is stopped or the correction values A, B, C, and D for the period where the fixing roller 6*b* is stopped after printing on the narrow paper, according to the operation condition of the fixing roller 6*b*, and then calculates the surface temperature of the fixing roller 6*b* (Tc'), so that a the precise temperature can be detected.

That is, within the time period Tw after the narrow medium is used in printing, the correction values A, B, C, and D used for calculating the surface temperature of the fixing roller 6*b* and the time where the fixing roller 6*b* stopped are sought in advance and held in the control unit 1. The correction value A[Tamb] can be calculated from the correction value A and the constants a and b, in the same manner as in the third embodiment. For example, the correction values A, B, C, and D for the period where the fixing roller 6*b* is stopped after printing on the narrow paper can be 1.30, −0.30, 0.00, and 1.20 respectively, and the constants a and b for the period where the fixing roller 6*b* is stopped after printing on the narrow paper can be 0.15 and 1.20 respectively. The correction value A[Tamb] is calculated for each of these values. The control unit 1 then selects either the constants a and b and the correction values A, B, C, and D for the period where the fixing roller 6*b* is rotating, the constants a and b and the correction values A, B, C, and D for the period where the fixing roller 6*b* is stopped, or the constants a and b and the correction values A, B, C, and D for the period where the fixing roller 6*b* is stopped after printing on the narrow paper, according to the operation condition of the fixing roller 6*b*, and then calculates the surface temperature of the fixing roller 6*b* (Tc'), so that a the precise temperature can be detected.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus having a fusion unit so as to fuse developer deposited on a medium, comprising:

a rotating body rotating in a feeding direction of said medium;

a heating source heating said rotating body;

a thermal unit for receiving radiated heat from said rotating body, disposed with a prescribed gap from said rotating body;

a first temperature detection unit for detecting a value of the temperature of said thermal unit;

a first holding unit for holding said thermal unit and said first temperature detection unit, the first holding unit having a first surface facing the rotating body and a second surface opposite to the first surface;

a second temperature detection unit for detecting a value of the temperature of said first holding unit;

a second holding unit for holding said second temperature detection unit, the second holding unit being disposed on the second surface of the first holding unit;

a storage unit storing a previously calculated rotation time correction value and a previously calculated stopped time correction value; and a temperature calculation unit for correcting the value of the temperature of said thermal unit detected by said first temperature detection unit based on the value of the temperature of said first holding unit detected by said second temperature detection unit and based on the rotation time correction value or the stopped time correction value and for calculating a surface temperature of said rotating body, wherein the stopped time correction value is different from the rotation time correction value, wherein the rotation time correction value is used for a period where the rotating body is rotating, such that, when the rotating body is rotating, the temperature calculation unit calculates the surface temperature of the rotating body according to the value of the temperature of said thermal unit, the value of the temperature of said first holding unit and the rotation time correction value, and wherein the stopped time correction value is used for a period where the rotating body is stopped, such that, when the rotating body is stopped, the temperature calculation unit calculates the surface temperature of the rotating body according to the value of the temperature of said thermal unit, the value of the temperature of said first holding unit and the stopped time correction value.

2. The image forming apparatus according to claim 1, wherein said temperature calculation unit, using the previously calculated rotation time correction value or stopped time correction value, corrects the value of the temperature of said thermal unit detected by said first temperature detection unit, based on the value of the temperature of said first holding unit detected by said second temperature detection unit, from a relationship among the value of the temperature of said thermal unit detected by said first temperature detection unit, the value of the temperature of said first holding unit detected by said second temperature detection unit, and the actual surface temperature of said rotating body, and calculates the surface temperature of said rotating body.

3. The image forming apparatus according to claim 1, further comprising a temperature storing unit for storing the value of the temperature of said thermal unit detected by said first temperature detection unit at every unit of time measured by a time measurement unit, wherein said temperature calculation unit corrects the temperature calculated with the value of the temperature of said first holding unit detected by said second temperature detection unit and the value of the temperature of said thermal unit detected by said first temperature detection unit based on an amount of change in temperature calculated from the temperature stored by said temperature storing unit at every unit of time, and calculates the surface temperature of said rotating body.

4. The image forming apparatus according to claim 2, further comprising a temperature storing unit for storing the value of the temperature of said thermal unit detected by said first temperature detection unit at every unit of time measured by a time measurement unit, wherein said temperature calculation unit corrects the temperature calculated with the value of the temperature of said first holding unit detected by said second temperature detection unit and the value of the temperature of said thermal unit detected by said first temperature detection unit based on an amount of change in temperature calculated from the temperature stored by said temperature storing unit at every unit of time, and calculates the surface temperature of said rotating body.

5. The image forming apparatus according to claim 2, wherein said previously calculated rotation time correction value or said previously calculated stopped time correction value is corrected based on the value of the temperature of said first holding unit detected by said second temperature detection unit.

6. The image forming apparatus according to claim 3, wherein the amount of temperature change at the prescribed time is corrected based on the value of the temperature of said first holding unit detected by said second temperature detection unit.

7. The image forming apparatus according to claim 1, wherein said thermal unit absorbs infrared radiation emitted from said rotating body.

8. The image forming apparatus according to claim 7, wherein a secondary stopped time correction value used in said temperature calculation unit when said rotating body is stopped after having executed a prescribed operation immediately before, is sought in advance, and wherein said temperature detection unit makes a judgment as to an operation condition of said rotating body and uses the secondary stopped time correction value in a case where said rotating body is stopped after having executed the prescribed operation immediately before.

9. The image forming apparatus according to claim 1, wherein a surface temperature of said rotating body is calculated by the following equation:

$$Tc=A\times Tnc+B\times Tamb+C,$$

wherein Tc is the surface temperature of said rotating body, Tnc is the value of the temperature of said thermal unit detected by said first temperature detection unit, Tamb is the value of the temperature of said first holding unit detected by said second temperature detection unit, and A, B and C are constants.

10. The image forming apparatus according to claim 1, wherein a surface temperature of said rotating body is calculated by the following equation:

$$Tc=A\times Tnc+B\times Tamb+C-D\times(dTnc/dT),$$

wherein Tc is the surface temperature of said rotating body, Tnc is the value of the temperature of said thermal unit detected by said first temperature detection unit, Tamb is the value of the temperature of said first holding unit detected by said second temperature detection unit, (dTnc/dT) is an amount of change in temperature calculated by said first temperature detection unit at a prescribed time (T), and A, B, C, and D are constants.

11. The image forming apparatus according to claim 1, wherein a surface temperature of said rotating body is calculated by the following equation:

$$Tc=A[Tamb]\times Tnc+B\times Tamb+C-D\times(dTnc/dT),$$

wherein Tc is the surface temperature of said rotating body, Tnc is the value of the temperature of said thermal unit by said first temperature detection unit, Tamb is the value of the temperature of said first holding unit detected by said second temperature detection unit, (dTnc/dT) is an amount of change in temperature calculated by said first temperature detection unit at a prescribed time (T), B, C, and D are constants, and A [Tamb] is a value that is calculated from the following equation:

$A[Tamb]=a\times Tamb+b$, wherein $a$ and $b$ are constants.

12. The image forming apparatus according to claim 1, wherein both of said first temperature detection unit and said second temperature detection unit are disposed at a position above said rotating body.

13. The image forming apparatus according to claim 1, wherein the storage unit further stores a medium temperature correction value that is calculated in advance within a prescribed time, after a narrow medium is used.

14. The image forming apparatus according to claim 1, wherein said thermal unit is disposed on top of said first holding unit, and said first temperature detection unit.

15. The image forming apparatus according to claim 1, wherein the first holding unit is plate-shaped.

16. The image forming apparatus according to claim 1, wherein:

the storage unit further stores a medium temperature correction value obtained when a medium having a narrow width is printed;

the temperature calculation unit judges whether the rotating body is stopped and whether the narrow medium has been printed previously; and in case where the rotating body is stopped and the narrow medium has been printed, the temperature calculation unit calculates the surface temperature of the rotating body based on the medium temperature correction value.

17. The image forming apparatus according to claim 16, wherein the medium temperature correction value is used where a time that the rotating body is stopped is within a prescribed time.

18. The image forming apparatus according to claim 1, further comprising a power distribution control unit for controlling a power distribution condition of said heating source such that a surface temperature of the rotating body is to be a prescribed target temperature, wherein the rotation time correction value is used for a period where the rotating body is rotating, such that, when the rotating body is rotating, the temperature calculation unit calculates the surface temperature of the rotating body according to the value of the corrected temperature of said thermal unit, the value of the temperature of said first holding unit and the rotation time correction value as a first surface temperature value, and wherein the stopped time correction value is used for a period where the rotating body is stopped, such that, when the rotating body is stopped, the temperature calculation unit calculates the surface temperature of the rotating body according to the value of the corrected temperature of said thermal unit, the value of the temperature of said first holding unit and the stopped time correction value as a second surface temperature value, and wherein said power distribution control unit controls the power distribution condition of said heating source, according to the first surface temperature value when the rotating body is rotating and accordingly to the second surface temperature value when the rotating body is stopped, to make the surface temperature of the rotating body be the same prescribed target temperature for both instances where the rotating body is rotating and stopped.

* * * * *